US011746523B2

(12) United States Patent
Udagawa et al.

(10) Patent No.: US 11,746,523 B2
(45) **Date of Patent: *Sep. 5, 2023**

(54) NOISE REDUCTION APPARATUS AND METHOD OF MAKING AND USING THE SAME

(71) Applicant: Knoll, Inc., East Greenville, PA (US)

(72) Inventors: Masamichi Harrison Udagawa, New York, NY (US); Sigrid Moeslinger, New York, NY (US); Benjamin A. Pardo, New York, NY (US); Roger Wall, Buffalo, NY (US)

(73) Assignee: Knoll, Inc., East Greenville, PA (US)

( * ) Notice: Subject to any disclaimer, the term of this patent is extended or adjusted under 35 U.S.C. 154(b) by 164 days.

This patent is subject to a terminal disclaimer.

(21) Appl. No.: 17/178,724

(22) Filed: Feb. 18, 2021

(65) Prior Publication Data

US 2021/0207368 A1 Jul. 8, 2021

Related U.S. Application Data

(63) Continuation of application No. 15/903,626, filed on Feb. 23, 2018, now Pat. No. 10,961,700.
(Continued)

(51) Int. Cl.
*E04B 1/84* (2006.01)
*E04B 9/32* (2006.01)
(Continued)

(52) U.S. Cl.
CPC ..... *E04B 1/84* (2013.01); *A47G 5/00* (2013.01); *E04B 1/86* (2013.01); *E04B 1/99* (2013.01);
(Continued)

(58) Field of Classification Search
CPC . E04B 1/8409; E04B 1/84; E04B 1/99; E04B 2001/8423; E04B 2001/8433;
(Continued)

(56) References Cited

U.S. PATENT DOCUMENTS 2,000,806 A 5/1935 White
2,011,557 A 8/1935 Anderegg
(Continued)

FOREIGN PATENT DOCUMENTS

DE 19754107 C1 * 2/1999 ..... E04B 1/8209
EP 1760210 A2 * 3/2007 ..... B29C 53/063
(Continued)

*Primary Examiner* — Edgardo San Martin
(74) *Attorney, Agent, or Firm* — Buchanan Ingersoll & Rooney PC

(57) ABSTRACT

A noise reduction apparatus can include a frame and multiple spaced apart panels positioned adjacent to each other. Each of the panels or only one of the spaced apart panel elements may have holes therein to receive acoustic waves for absorbing the waves between the panels. The panels can be attached to a frame or other connection structure so that the arrangement of panels can be hung over a work space or positioned in a work space (e.g. in a wall, formed as a partition or wall, included as part of shelving, etc.). The panels can also be incorporated into a light fixture that may hang from a ceiling or be attached to some other type of support (e.g. a table, a base, etc.). The panels can be composed of glass, wood, or other type of material.

20 Claims, 27 Drawing Sheets

Related U.S. Application Data

(60) Provisional application No. 62/463,951, filed on Feb. 27, 2017.

(51) Int. Cl.

| | |
|---|---|
| ***E04B 9/36*** | (2006.01) |
| ***A47G 5/00*** | (2006.01) |
| ***E04B 1/86*** | (2006.01) |
| ***E04B 2/74*** | (2006.01) |
| ***E04B 1/99*** | (2006.01) |
| ***F21S 8/06*** | (2006.01) |
| ***G10K 11/162*** | (2006.01) |
| *E04B 1/82* | (2006.01) |

(52) U.S. Cl.

CPC ..... *E04B 2/7409* (2013.01); *E04B 2/7422* (2013.01); *E04B 9/363* (2013.01); *E04B 9/366* (2013.01); *F21S 8/06* (2013.01); *G10K 11/162* (2013.01); *E04B 2001/829* (2013.01); *E04B 2001/8263* (2013.01); *E04B 2001/8281* (2013.01); *E04B 2001/848* (2013.01); *E04B 2001/849* (2013.01); *E04B 2001/8433* (2013.01)

(58) Field of Classification Search

CPC ..... E04B 2001/8447; E04B 2001/8452; E04B 2001/8263; E04B 2001/8281; E04B 9/32; E04B 9/34; E04B 9/36; E04B 9/363; E04B 9/366; E04B 2/7409; F21S 8/06

See application file for complete search history.

(56) References Cited

U.S. PATENT DOCUMENTS

| | | | | |
|---|---|---|---|---|
| 2,159,488 | A | 5/1939 | Parkinson | |
| 2,287,079 | A | 6/1942 | Anderson | |
| 2,502,016 | A | 3/1950 | Olson | |
| D164,734 | S | 10/1951 | Quinn | |
| 2,656,004 | A | 10/1953 | Olson | |
| 2,821,450 | A | 1/1958 | Knoll | |
| 3,460,299 | A | 8/1969 | Wilson | |
| 3,777,437 | A | 12/1973 | Christen | |
| 3,875,706 | A | 4/1975 | Okawa | |
| 5,094,174 | A | 3/1992 | Grund et al. | |
| 5,111,770 | A | 5/1992 | Weelink | |
| 5,131,194 | A | 7/1992 | Anderson | |
| 5,155,955 | A | 10/1992 | Ball et al. | |
| 5,287,909 | A | 2/1994 | King et al. | |
| 5,532,440 | A | 7/1996 | Fujiwara | |
| 5,700,527 | A | 12/1997 | Fuchs et al. | |
| 5,921,040 | A | 7/1999 | Glashouwer et al. | |
| 6,000,180 | A | 12/1999 | Goodman et al. | |
| 6,021,613 | A | 2/2000 | Reuter et al. | |
| 6,073,399 | A | 6/2000 | Shipman et al. | |
| 6,367,581 | B1 | 4/2002 | Marler et al. | |
| 6,430,894 | B1 | 8/2002 | Chae et al. | |
| 6,625,935 | B1 | 9/2003 | King et al. | |
| 6,941,721 | B2 | 9/2005 | Lind | |
| 7,658,046 | B2 | 2/2010 | Lynch et al. | |
| 8,100,225 | B2 * | 1/2012 | Bartha | E04B 1/86 181/290 |
| 8,365,798 | B2 | 2/2013 | Feldpausch et al. | |
| 8,628,049 | B2 | 1/2014 | Ghatikar | |
| 9,147,390 | B2 | 9/2015 | Swinkels et al. | |
| 9,194,124 | B2 | 11/2015 | Johnson et al. | |
| 9,453,361 | B2 | 9/2016 | Montgermont et al. | |
| 10,134,379 | B2 | 11/2018 | Krasnov | |
| 10,260,231 | B2 | 4/2019 | Scherrer | |
| 10,359,163 | B1 | 7/2019 | Hettwer et al. | |
| 10,458,115 | B2 | 10/2019 | McPhillips | |
| 10,672,376 | B1 | 6/2020 | Pickens | |
| 10,961,700 | B2 * | 3/2021 | Udagawa | E04B 1/86 |
| 2002/0189180 | A1 | 12/2002 | King et al. | |
| 2004/0191474 | A1 | 9/2004 | Yamagiwa et al. | |
| 2007/0000201 | A1 | 1/2007 | Kennedy et al. | |
| 2009/0029339 | A1 | 1/2009 | Botha et al. | |
| 2015/0267402 | A1 | 9/2015 | Borrelli et al. | |
| 2018/0245334 | A1 | 8/2018 | Udagawa et al. | |
| 2019/0161966 | A1 * | 5/2019 | Friez | E04B 9/30 |

FOREIGN PATENT DOCUMENTS

| | | | | |
|---|---|---|---|---|
| EP | 1842977 | A1 * | 10/2007 | E01F 8/0017 |
| WO | 2015/142978 | A1 | 9/2015 | |

* cited by examiner

NOISE REDUCTION APPARATUS AND METHOD OF MAKING AND USING THE SAME

CROSS-REFERENCE TO RELATED APPLICATIONS

The present patent application is a continuation application of U.S. patent application Ser. No. 15/903,626, which claims priority to U.S. Provisional Patent Application No. 62/463,951, filed on Feb. 27, 2017. The entirety of this provisional patent application is incorporated by reference herein.

FIELD OF THE INVENTION

Embodiments of the present invention relate to furniture systems, furniture, lighting, wall coverings such as cubicle partitions, privacy screens, wall paneling, and noise reduction baffles. Embodiments of the present invention also relate to methods of making furniture, partition structures (e.g. booths, partition walls, etc.), and/or baffles that utilize glass panel elements that can be used to fabricate such noise reduction apparatuses.

BACKGROUND OF THE INVENTION

Furniture systems can be utilized in a number of different settings. In office settings, cubicle systems are often used to partition a work space into a number of different work areas. For example, cubicle partitions and privacy screens may be utilized to help define different work areas within a floor of an office building. Examples of such cubicle partitions and privacy screens can be appreciated from U.S. Pat. Nos. 2,287,079, 2,821,450, 3,777,437, 5,094,174, 5,111,770, 5,155,955, 5,287,909, 5,921,040, 6,000,180, 6,021,613, 6,073,399, 6,625,935, 8,365,798, and D164,734, and U.S. Patent Application Publication Nos. 2002/0189180 and 2009/029339.

Work spaces can be designed to be relatively open. Such arrangements can have large acoustic noise profiles due to working personnel sharing the same work space. The high volume of this acoustic noise can make it difficult for co-workers to communicate with each other, collaborate, or perform certain tasks.

SUMMARY OF THE INVENTION

A noise reduction apparatus can be provided as furniture (e.g. booths, privacy screen structures, shelves, partition walls, etc.), incorporated into a light fixture, or be designed as a wall covering, a baffle, or other type of apparatus for reducing the acoustic noise in a work space by absorbing a certain level of the audible, or acoustic, noise generated by workers within the work space. The noise reduction can help decrease the volume of audible noise (or acoustic noise) within the work space.

Embodiments of a noise reduction apparatus can include a first glass panel element having holes defined therein and a second glass panel element having holes defined therein positioned adjacent and spaced apart from the first glass panel element to define a gap between the first and second glass panel elements. The holes of the first glass panel element and the second glass panel element can be in fluid communication with the gap to direct acoustic waves into the gap for absorbing sound within the gap to reduce audible noise within a work space in which the noise reduction apparatus is positionable.

Embodiments of the noise reduction apparatus can include a frame. The frame can be an upper frame, a frame that is positioned about the entire periphery of each glass panel, or other type of frame that is connected to the first and second glass panel element. The frame can be configured to fully enclose the gap or partially enclose the gap. In some embodiments, the frame can include a first frame member having a first groove and a second groove and a second frame member having a first groove and a second groove. A first edge of the first glass panel element can be within the first groove of the first frame member and a second edge of the first glass panel element can be within the first groove of the second frame member. A first edge of the second glass panel element can be within the second groove of the first frame member and a second edge of the second glass panel element can be within the second groove of the second frame member. In other embodiments, the frame can be configured to include a first frame member having a first groove and a second groove where a first edge of the first glass panel element is within the first groove of the first frame member and a first edge of the second glass panel element is within the second groove of the first frame member. An adhesive or other type of attachment mechanism can be utilized to help attach the glass panel elements to one or more frame members as well.

In other embodiments, the noise reduction apparatus can be frameless. In some embodiments, a first connector can be positioned in the gap and a second connector can be positioned within the gap such that the first connector extends between the first and second glass panel elements adjacent a first side of the glass panel element and adjacent a first side of the second glass panel element and the second connector extends between the first and second glass panel elements adjacent a second side of the first glass panel element and adjacent a second side of the second glass panel element. The first and second sides of the glass panel elements can be opposite sides (e.g. front and back sides, left and right sides, top and bottom sides, etc.).

In some embodiments, the noise reduction apparatus can be configured to include a light emitting device so that it can be configured to provide lighting to a work space in addition to providing noise reduction. For instance, an embodiment can include an upper frame element attached to a light emitting device. The first glass panel element can be attached to a first side of the upper frame element and the second glass panel element can be attached to a second side of the upper frame element. The light emitting device can be connected to the upper frame so that it is positioned between the first and second glass panel elements.

In some embodiments, the noise reduction apparatus can be configured as a wall, ceiling, a partition, or a type of noise privacy screen. For instance, the first and second glass panel elements can at least partially define a tile that is mountable adjacent to a work surface.

In other embodiments, a noise reduction apparatus can include a frame; a plurality of first glass panel elements having holes and a plurality of second glass panel elements having holes. Each of the second glass panel elements can be spaced apart from and positioned opposite a corresponding one of the first glass panel elements to define a gap therebetween. The frame can be attached to the first and second glass panel elements so that the gaps are in communication with each other and form a cavity. The holes of the first glass panel elements and the holes of the second glass panel elements can be in communication with the cavity such that acoustic waves passing through air adjacent the noise reduction apparatus are passable into the cavity via the holes for sound absorption. In some embodiments, at least one mounting device can be attached to the frame for positioning the noise reduction apparatus in or above a workspace.

The frame for such apparatuses can have any number of configurations. For instance, the frame can include a first frame member having a first groove and a second groove and a second frame member having a first groove and a second groove. A first edge of each of the first glass panel elements can be within the first groove of the first frame member and a second edge of each of the first glass panel elements can be within the first groove of the second frame member. A first edge of each of the second glass panel elements can be within the second groove of the first frame member and a second edge of each of the second glass panel elements can be within the second groove of the second frame member. An adhesive or other type of attachment mechanism can also be included to help attach the frame members to the glass panel elements. In other embodiments, the frame can include an upper frame element having a first groove and a second groove spaced apart from the first groove where an upper edge of each of the first glass panel elements is positioned within the first groove and an upper edge of each of the second glass panel elements is positioned within the second groove.

Methods of providing a noise reduction apparatus and using such an apparatus are also provided. For instance, a method of providing a noise reduction apparatus can include obtaining glass for glass panel elements and positioning a first glass panel element having holes defined therein adjacent a second glass panel element having holes defined therein, the second glass panel element positioned adjacent and spaced apart from the first glass panel element to define a gap between the first and second glass panel elements. The holes of the first and second glass panel elements can be in fluid communication with the gap to direct acoustic waves into the gap for absorbing sound within the gap to reduce audible noise within a work space in which the noise reduction apparatus is positionable. In some embodiments of the method, the method can also include attaching a frame to the first glass panel element and to the second glass panel element. In other embodiments, the method can include attaching a first connector to the first glass panel and the second glass panel element such that the first connector extends between the first and second glass panel elements within the gap adjacent a first side of the first glass panel element and adjacent a first side of the second glass panel element and can also include attaching a second connector to the first glass panel and the second glass panel element such that the second connector extends between the first glass panel element within the gap and second glass panel element adjacent a second side of the first glass panel element and adjacent a second side of the second glass panel element. In some embodiments, the method can also (or alternatively) include attaching an upper frame element to the first glass panel element and the second glass panel element such that the first glass panel element is attached to a first side of the upper frame element and the second glass panel element is attached to a second side of the upper frame element and attaching a light emitting device to the upper frame element so that the light emitting device is positioned between the first and second glass panel elements.

In some embodiments of the noise reduction apparatus and the method, the second glass panel element can be replaced with a different type of panel element (e.g. a wood panel element or a solid glass panel element) that does not have holes in fluid communication with a gap defined between the first glass panel element and the second panel element. For instance, embodiments of the noise reduction apparatus can include a first glass panel element having holes defined therein and a second panel element positioned adjacent and spaced apart from the first glass panel element to define a gap between the first glass panel element and the second panel element. The holes of the first glass panel element can be in fluid communication with the gap to direct acoustic waves into the gap for absorbing sound within the gap to reduce audible noise within a work space in which the noise reduction apparatus is positionable.

As another example of such embodiments, an embodiment of a method of providing a noise reduction apparatus can include obtaining glass for glass panel elements and positioning a first glass panel element having holes defined therein adjacent a second panel element so that the second panel element is positioned adjacent and spaced apart from the first glass panel element to define a gap between the first glass panel element and second panel element. The holes of the first glass panel element can be in fluid communication with the gap to direct acoustic waves into the gap for absorbing sound within the gap to reduce audible noise within a work space in which the noise reduction apparatus is positionable.

Other details, objects, and advantages of the privacy apparatus and method will become apparent as the following description of certain exemplary embodiments thereof proceeds.

BRIEF DESCRIPTION OF THE DRAWINGS

Exemplary embodiments of noise reducing furniture, noise reducing baffles, and methods of making the same are shown in the accompanying drawings. It should be understood that like reference numbers used in the drawings may identify like components.

DETAILED DESCRIPTION OF EXEMPLARY EMBODIMENTS

Figure 1:
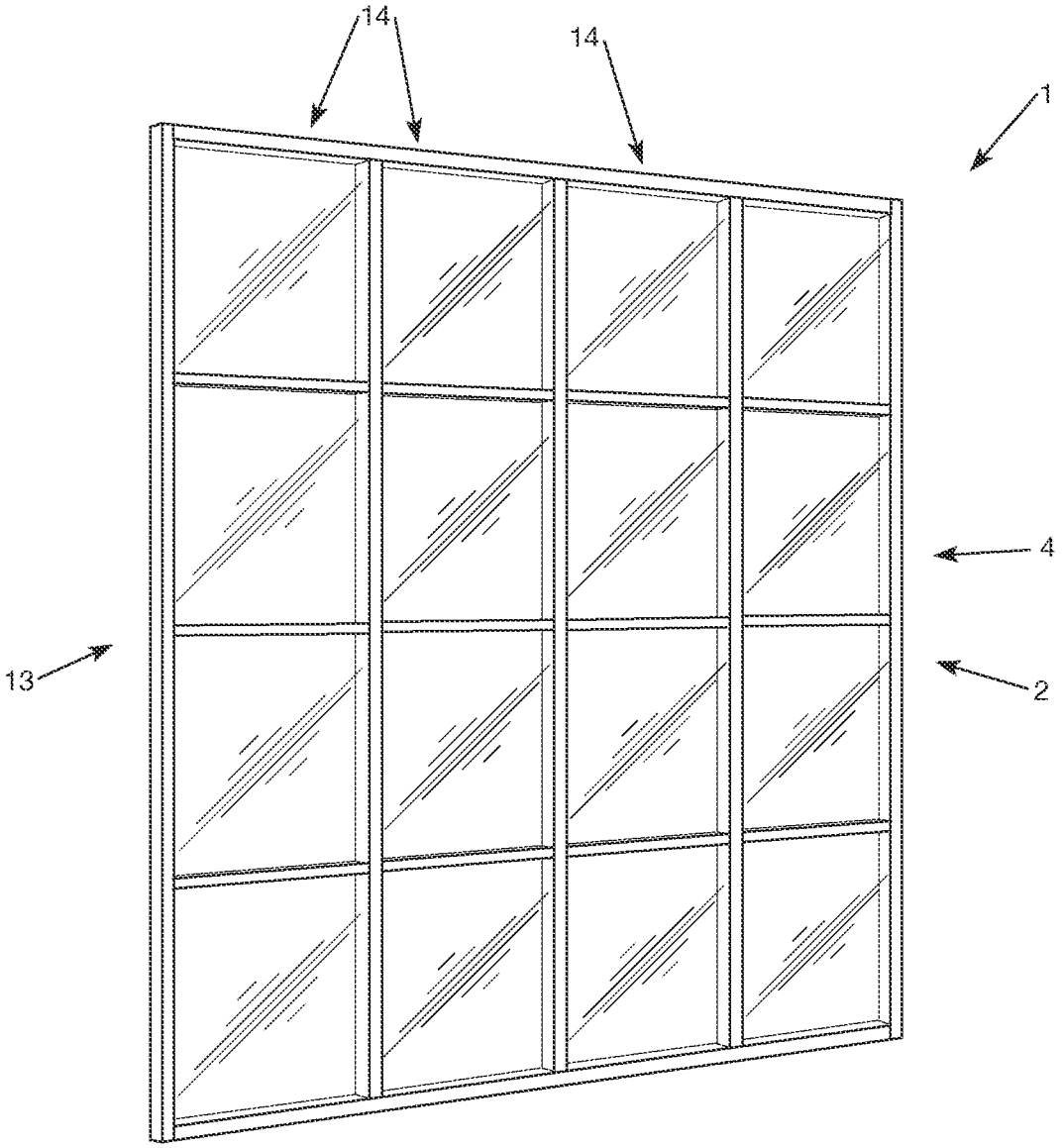
FIG. 1 is a perspective view of a first exemplary embodiment of a noise reduction apparatus, which is configured as a wall covering 2.
Figure 2:
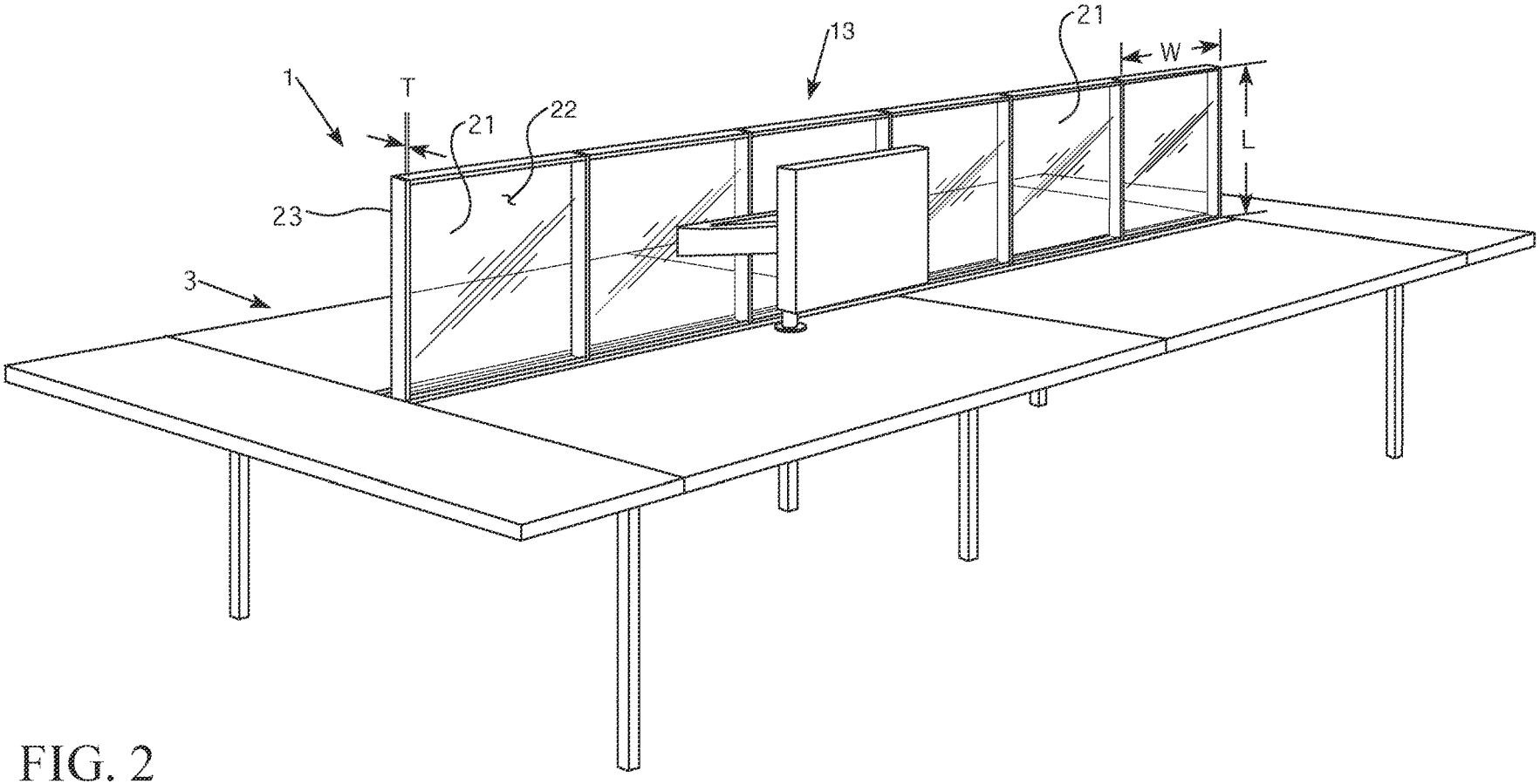
FIG. 2 is a perspective view of a second exemplary embodiment of a noise reduction apparatus, which is configured as a work surface mounted apparatus 3.
Figure 3:
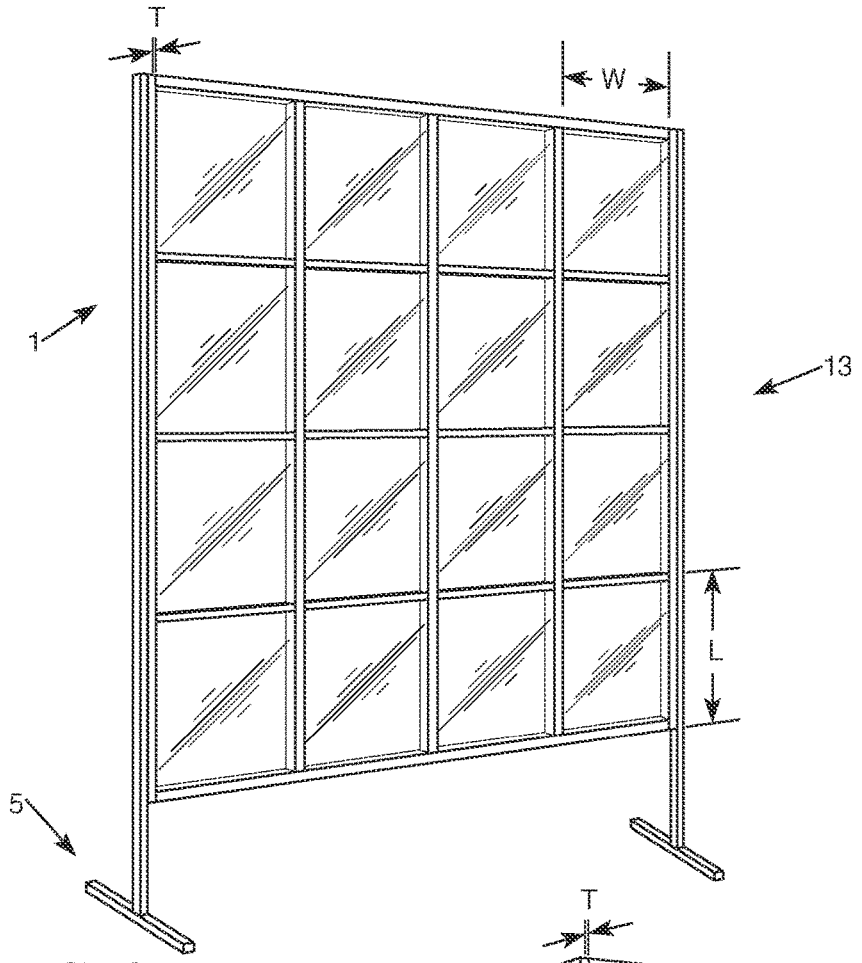
FIG. 3 is a perspective view of a third exemplary embodiment of a noise reduction apparatus, which is configured as a freestanding partition 5.
Figure 4:
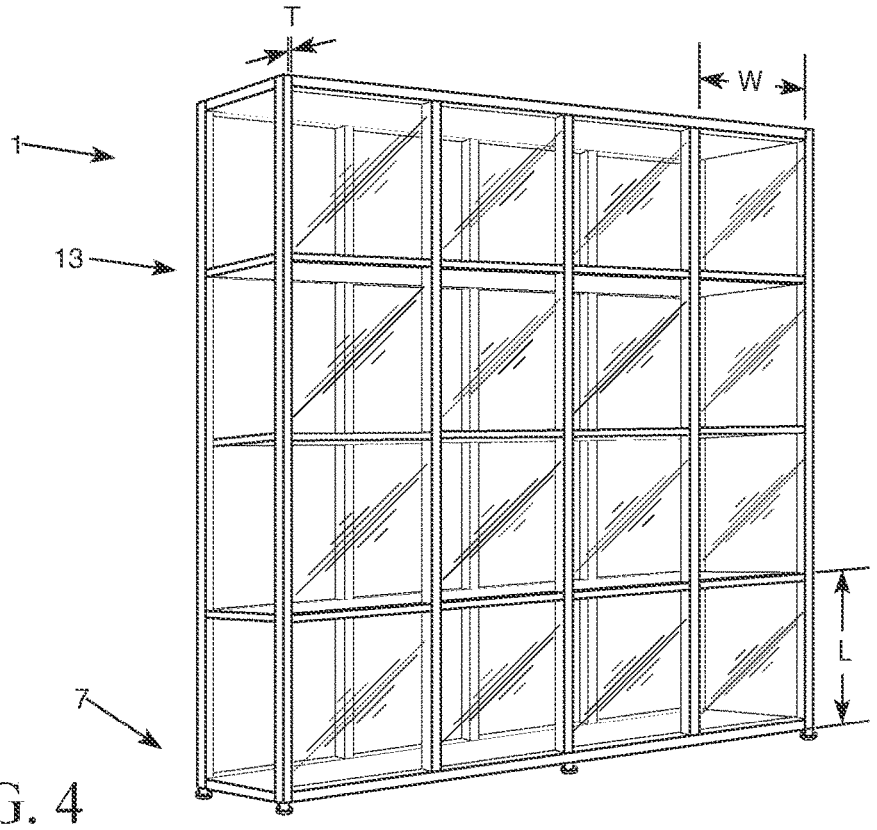
FIG. 4 is a perspective view of a fourth exemplary embodiment of a noise reduction apparatus, which is configured as freestanding furniture 7 (e.g. a shelving unit).
Figure 5:
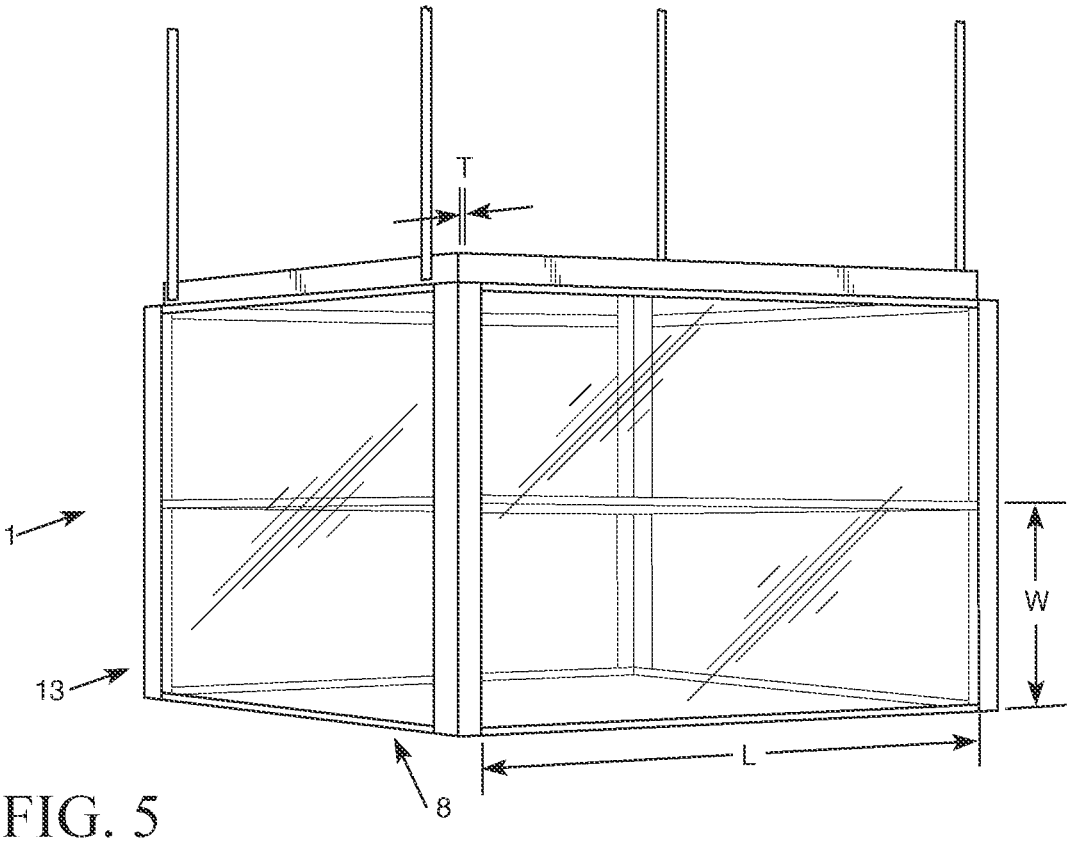
FIG. 5 is a perspective view of a fifth exemplary embodiment of a noise reduction apparatus, which is configured as a hanging booth 8.
Figure 6:
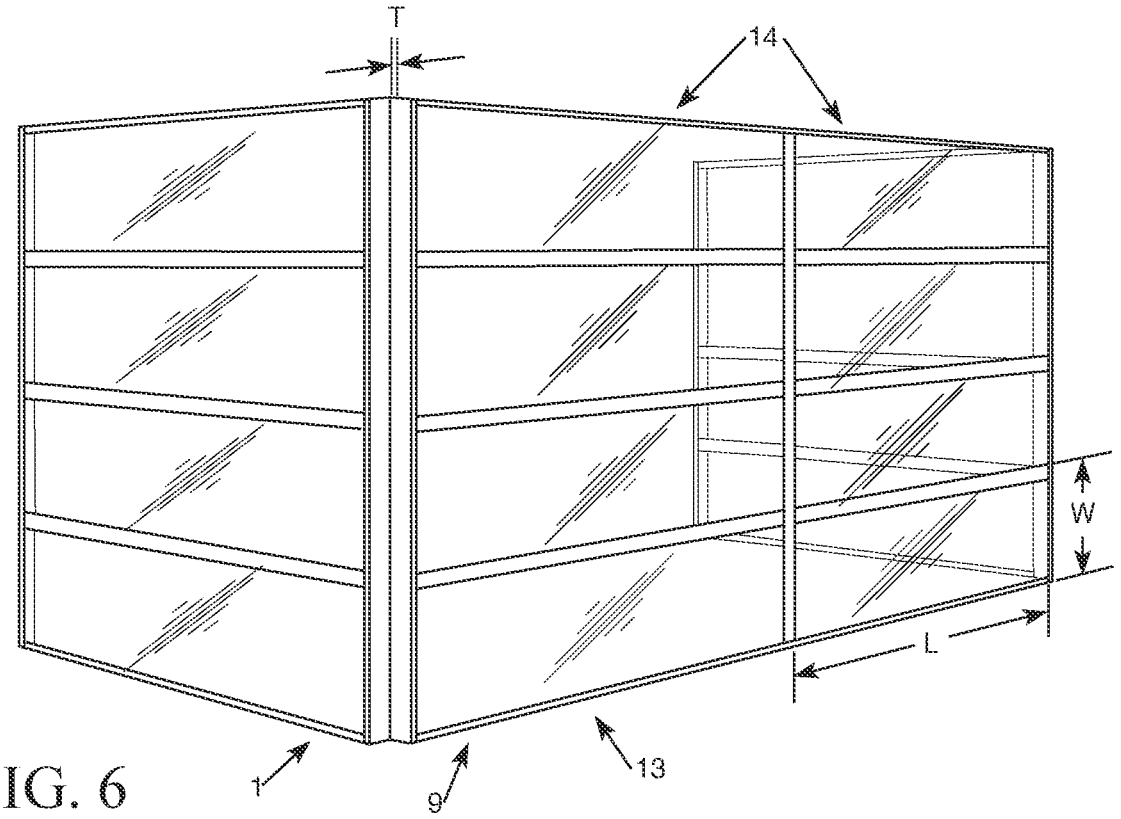
FIG. 6 is a perspective view of a sixth exemplary embodiment of a noise reduction apparatus, which is configured as a room 9.
Figure 7:
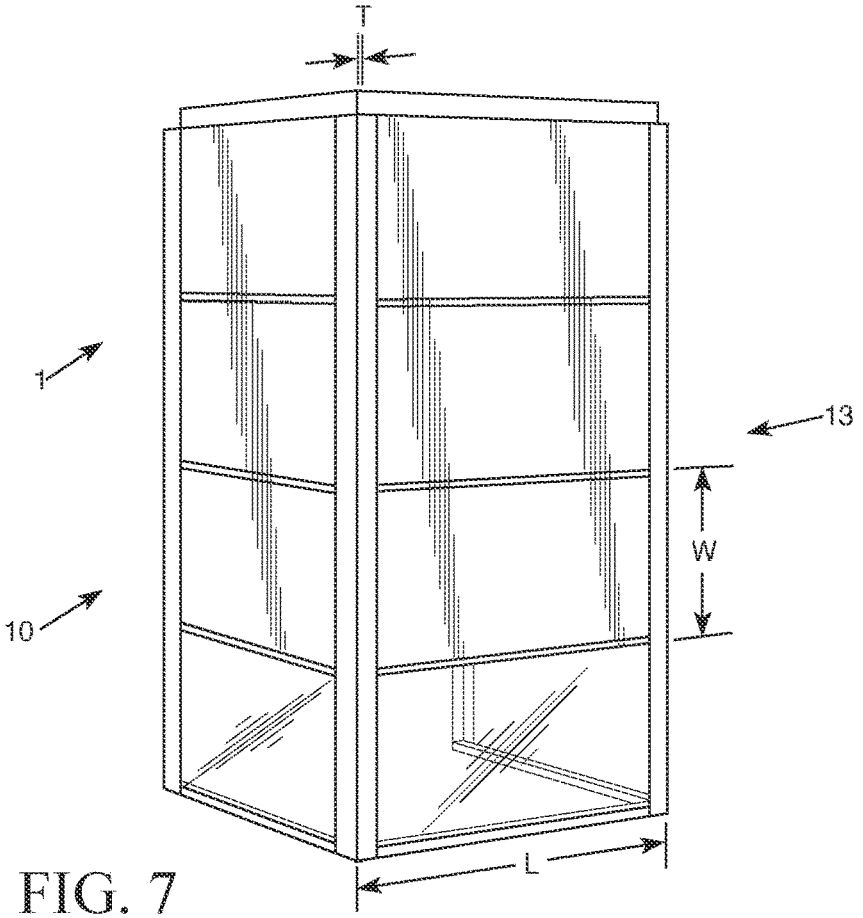
FIG. 7 is a perspective view of a seventh exemplary embodiment of a noise reduction apparatus, which is configured as a free standing booth 10.
Figure 8:
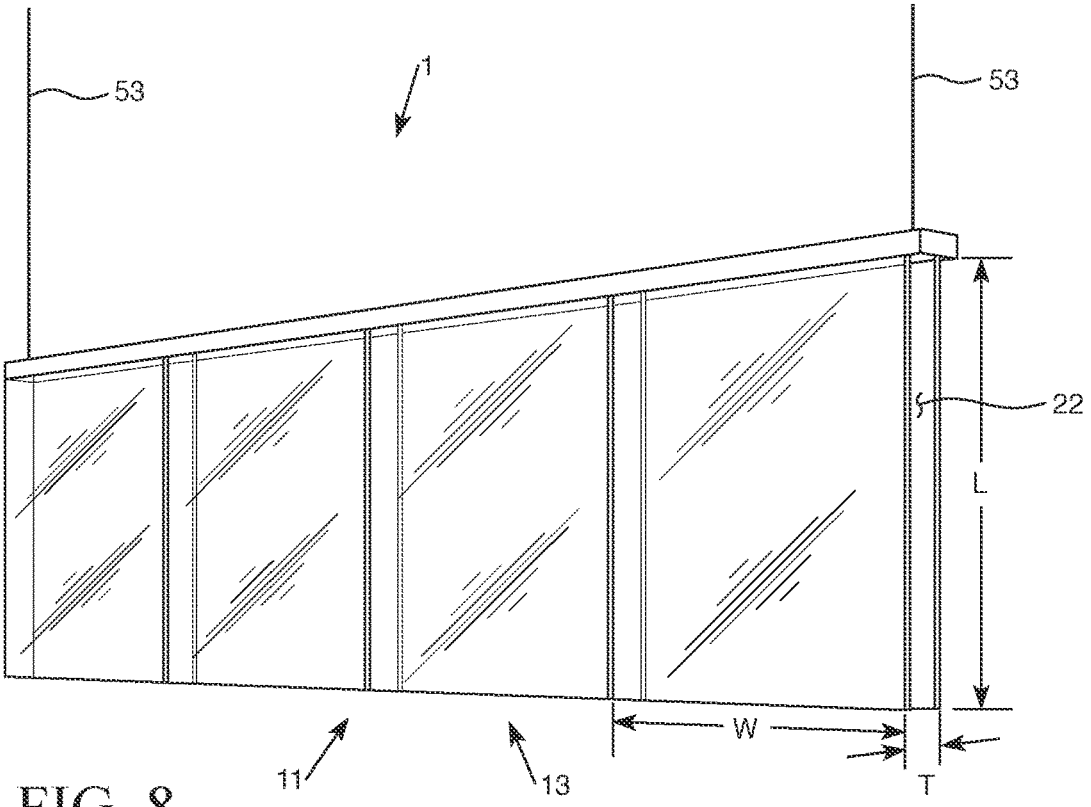
FIG. 8 is a perspective view of an eighth exemplary embodiment of a noise reduction apparatus, which is configured as a first hanging light fixture 11.
Figure 9:
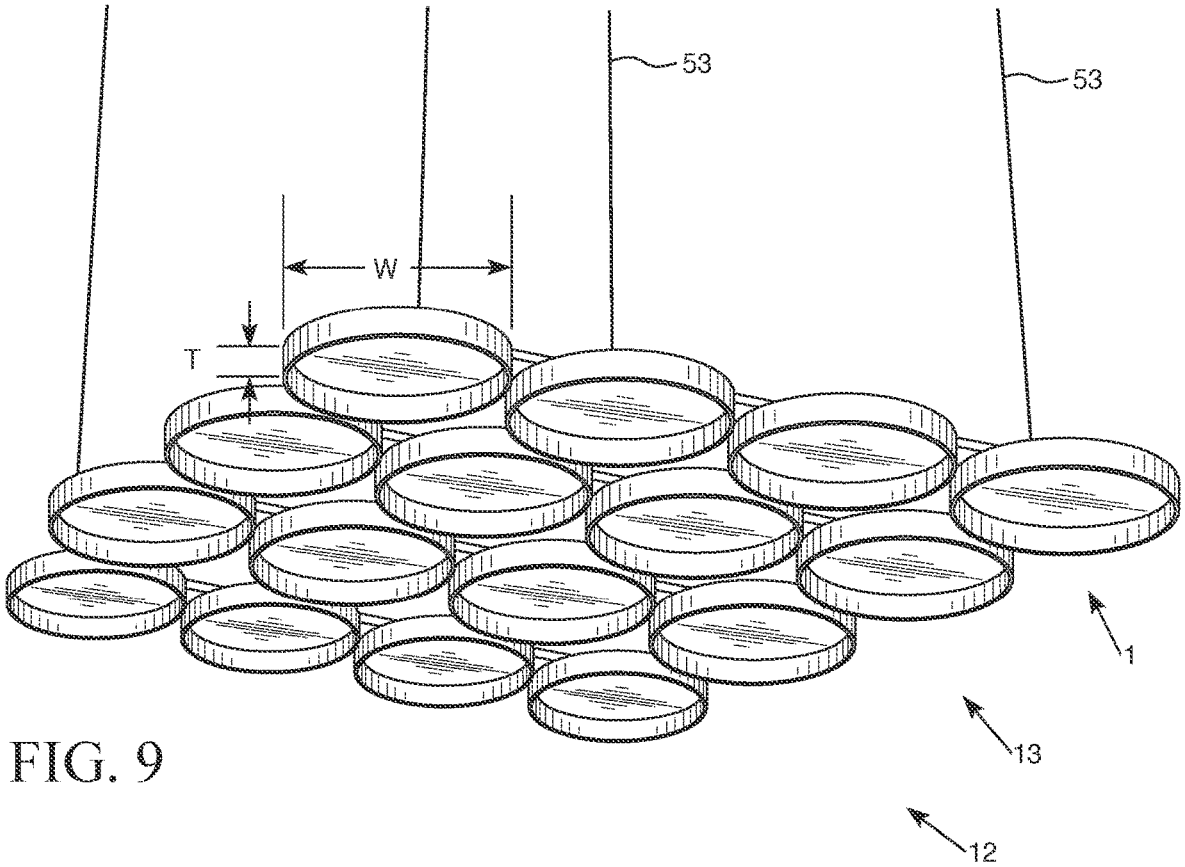
FIG. 9 is a perspective view of a ninth exemplary embodiment of a noise reduction apparatus, which is configured as a second hanging light fixture 12.
Figure 10:
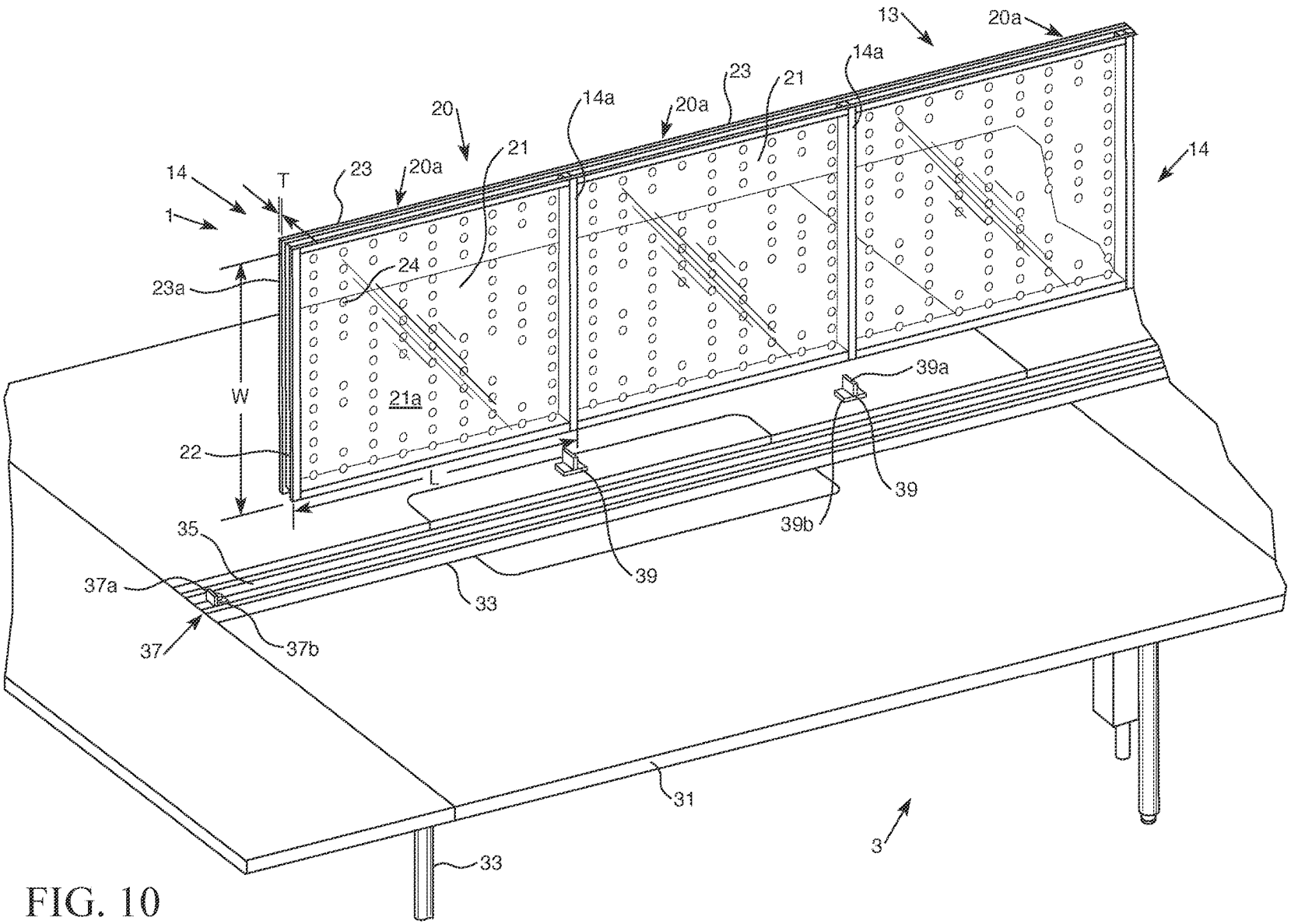
FIG. 10 is a fragmentary perspective view of the second exemplary embodiment of the noise reduction apparatus.
Figure 11:
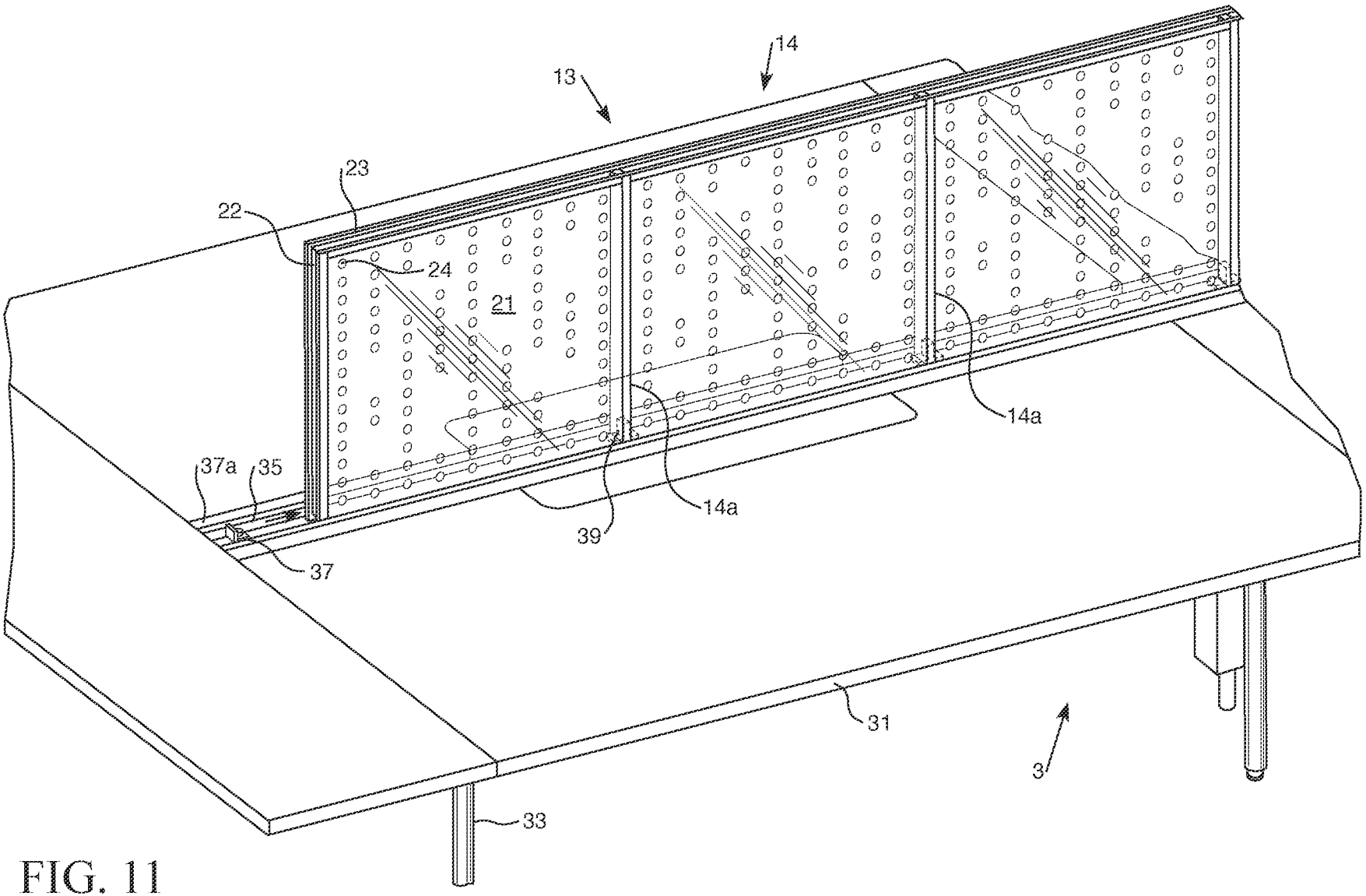
FIG. 11 is a fragmentary perspective view of the second exemplary embodiment of the noise reduction apparatus.
Figure 12:
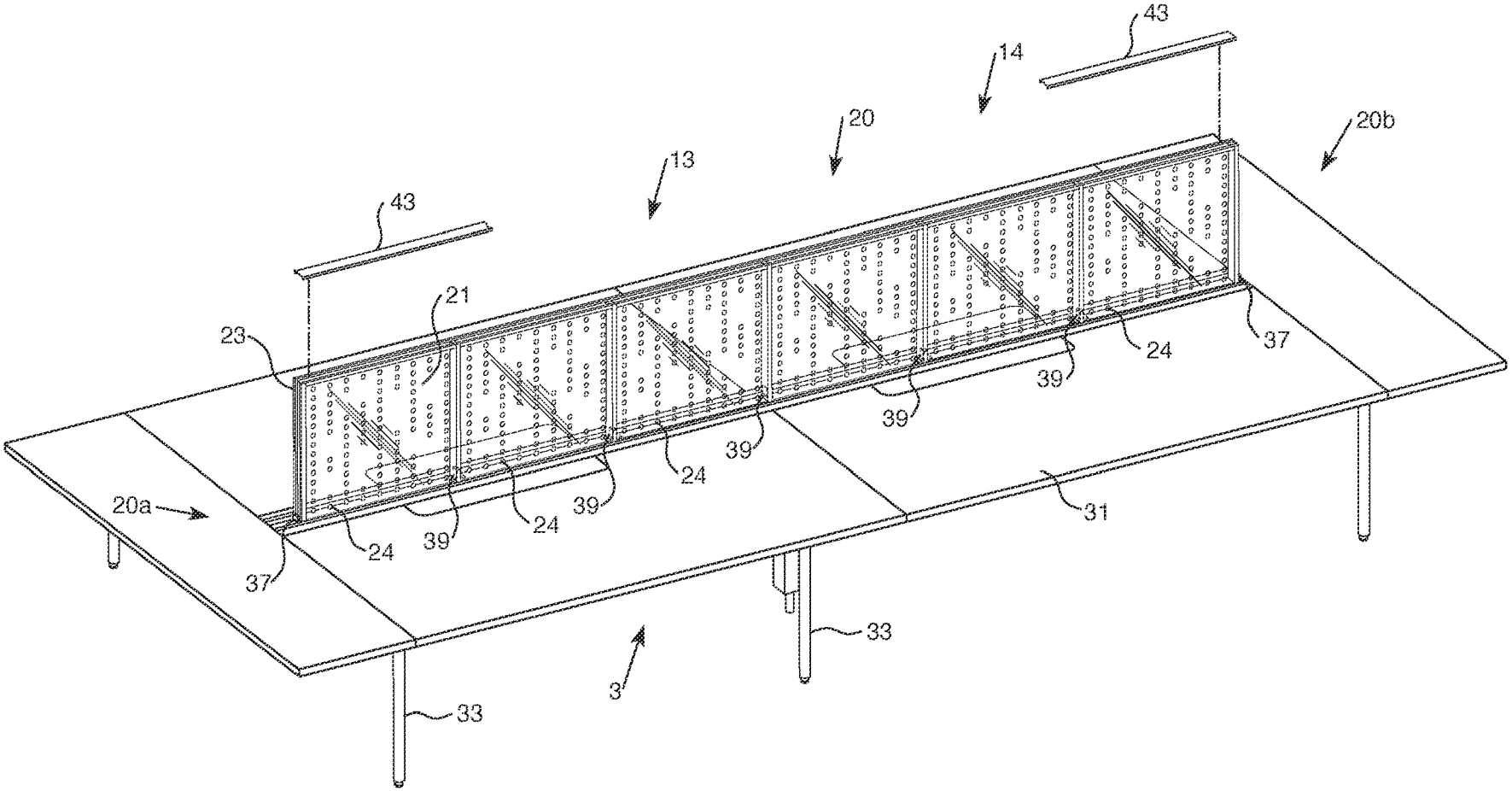
FIG. 12 is an exploded view of the second exemplary embodiment of the noise reduction apparatus.
Figure 13:
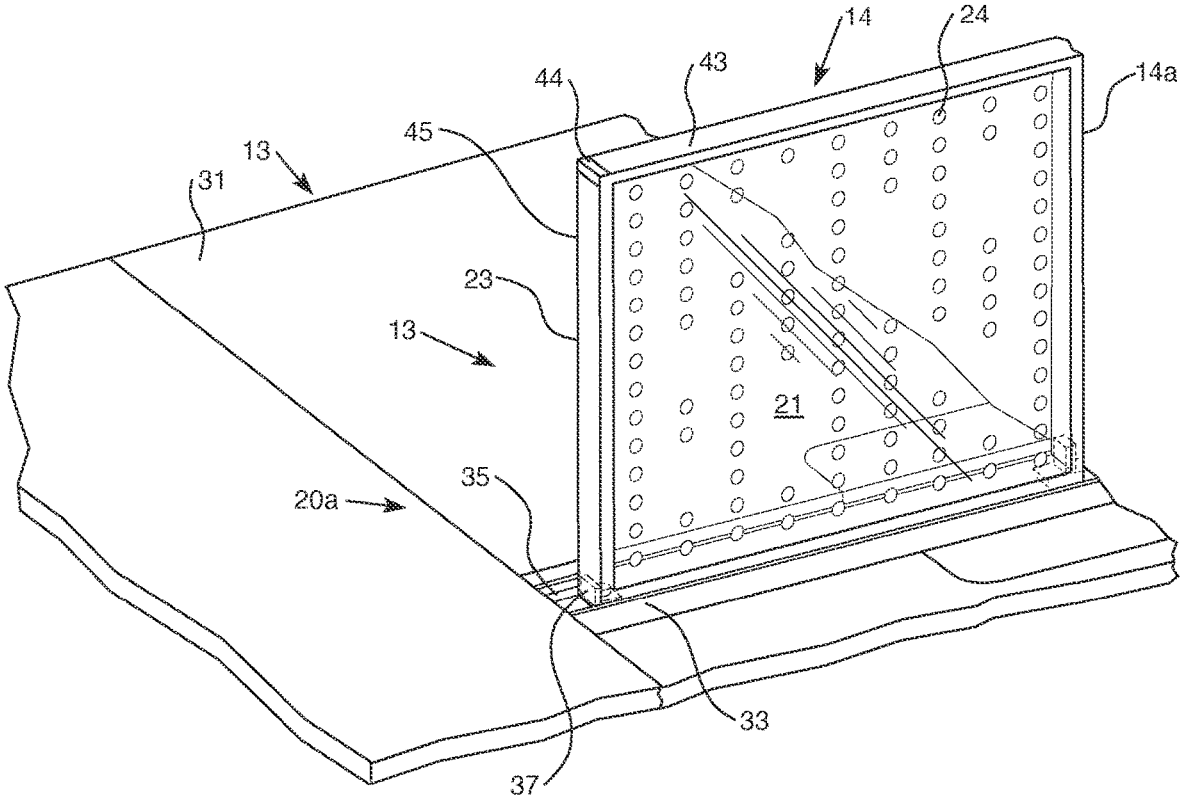
FIG. 13 is a fragmentary perspective view of the second exemplary embodiment of the noise reduction apparatus.

Embodiments of a noise reduction apparatus may be appreciated from FIGS. 1-9, 14-15, 22-23, 27, and 34. The noise reduction apparatus can be configured as a wall 4 mounted wall covering 2, a work surface mounted partition 3, which may be configured as a privacy screen type structure or a display screen mounting structure, a free standing partition 5, free standing furniture (e.g. a shelving unit, etc.), a hanging booth 8, walls that define a room 9, a free standing booth 10, a first hanging light fixture 11, a second hanging light fixture 12, a first type of noise reduction baffle 51 that may hang from a ceiling or be otherwise mounted for positioning above a work space (e.g. hang from walls of a room in a building or hang from one or more walls of a building via a mounting structure attached to at least one wall, etc.) or a second type of noise reduction baffle 71 that may hang from a ceiling or be otherwise mounted for positioning above a work space.

Embodiments of the noise reduction apparatus can each include at least a first glass panel element 21 and a second glass panel element 23 that is positioned away from the first glass panel element 23 to define a gap 22 between the first glass panel element and second glass panel element. In some embodiments, the glass panel elements can be planar glass plates or glass panels that are polygonal in shape (e.g. rectangular, hexagonal, triangular, etc.). In other embodiments, the glass panel elements may be glass plates that are circular or oval in shape or have an irregular shape or other type of shape. Each of the glass panel elements may have a length L, a width W, and a thickness T. The thickness T of the glass panel elements may be 2-3 mm in some embodiments. In other embodiments, the glass panel elements may have a greater thickness or a lesser thickness. The length L and width W of the glass panel elements can be any dimension that is desired to meet a particular design objective. The length and width will both typically be much greater in distance than the thickness T. For instance, some embodiments may utilize glass panel elements that have a length L of between 20 centimeters (cm) to 100 cm, a width of between 20 cm to 100 cm, and a thickness T of between 2 mm to 3 mm, between 2.3 mm to 2.7 mm, or a thickness T of 2.5 mm. In other embodiments, the glass panel elements may have a length L of greater than 25 cm, a width W of greater than 25 cm, and a thickness T of between 2-3 mm, between 2.3-2.7 mm, or a thickness T of 2.5 mm. In yet other embodiments, the length and width of the glass panel elements may be at least 25 cm (e.g. 25 cm, 50, cm, 75 cm, 100 cm, 115 cm, 200 cm, etc.) and the thickness of the glass panels may be between 2-3 mm less than 2.5 mm, or greater than 3 mm (e.g. 3.5 mm, 4 mm, etc.). If the glass panel element is circular in shape, it may have a diameter, which can be considered its width W, and also have a thickness T.

The glass composition of each glass panel element can be a glass sold under the Gorilla trade name or include such glass. In some embodiments, the glass of the glass panel elements may be purchased from Corning Inc. The glass of the glass panel elements can be tempered to help ensure safety of personnel that may interact with the noise reduction apparatus or walk or work under embodiments of a noise reduction apparatus having such glass panel elements. In other embodiments, the glass of the glass panel elements could be made of (or composed of) another type of material, such as an acrylic glass or poly(methyl methacrylate) (e.g. "Plexiglas", "Perspex", "Crylux", "Acrylite", "Lucite", "Duraplex", etc.). Poly(methyl methacrylate) is also referred to as the acronym PMMA.

The first and second glass panel elements 21 and 23 can each have a plurality of holes 24 formed therein so that the holes 24 are in fluid communication with the gap 22 such that sound waves traveling through air near the glass panels can pass through the holes 24 and into the gap 22. Each of the holes 24 can be relatively small in diameter D and may be formed by laser etching or other hole forming process for forming holes 24 within the bodies of the glass panel elements. In some embodiments, the diameter D of each hole 24 may be between 0.1 millimeter (mm) to 0.5 mm or between 0.01 mm to 0.05 mm. In some embodiment, the holes may be polygonal shaped or oval shaped instead of circular and have a width and length that are each between 0.1 mm and 0.5 mm or between 0.01 mm to 0.05 mm. In yet other embodiments, only one or more first glass panel elements 21 may have holes 24 and the second glass panel elements 23 may not have holes.

The first and second glass panel elements 21 and 23 can be positioned to form a gap 22 and have holes 24 so that acoustic waves that may travel through air pass through the holes 24 and into the gap 22. The acoustic waves may then be absorbed within the gap. Embodiments of the glass panel elements 21 and 23 that define the gap 22 can be configured to provide a noise reduction that is substantial. For instance, in some embodiments, the glass panel element arrangement can be configured to provide a noise reduction coefficient (commonly abbreviated as "NRC") that is greater than 0.4 (e.g. 0.5 to 0.7, 0.45 to 0.75, etc.).

The NRC is a measurement indicating how well a structure may stop sound from reflecting (e.g. how much sound they can absorb). The NRC is often a percentage of sound that a surface absorbs (e.g. hits a surface and doesn't reflect back again into the room). It should be understood that the NRC of a particular embodiment can be determined from the arithmetic average, rounded to the nearest multiple of 0.05 of the absorption coefficients for a specific material and mounting condition determined at the octave band center frequencies of 250 Hertz (Hz), 500 Hz, 1000 Hz and 2000 Hz. The absorption coefficients of materials can be determined through use of standardized testing procedures, such as ASTM C423, which is often used to evaluate the absorption of materials in eighteen one-third octave frequency bands with center frequencies ranging from 100 Hz to 5000 Hz. The absorption coefficients used to calculate NRC are typically determined in reverberation rooms of qualified acoustical laboratory test facilities using samples of the particular materials of specified size and mounting.

Glass structures often have an NRC that is relatively low, such as 0.05 as glass typically reflects acoustic waves instead of absorbing such waves. But, embodiments of the noise reduction apparatus can be configured to provide a substantially better NRC that is at least 0.4 NRC (e.g. 0.5-0.7, 0.45-0.65, or 0.6-0.75). Moreover, use of glass panel elements can permit such structures to provide a desired aesthetic effect because glass can be clear, or transparent in color in addition to being pigmented to be a particular type of color (e.g. blue, yellow, green, etc.). For instance, configured as a baffle, embodiments of the noise reduction apparatus can be positioned over a work space and provide a relatively un-noticeable structure that is clear, or fully transparent. A work space with a large ceiling may therefore retain its open space feel while also providing baffles that help substantially reduce the acoustic volume (or noise level) within a work space.

It is also contemplated that other embodiments may utilize glass panel elements can also be pigmented so that they are relatively transparent, but also colored (e.g. a relatively transparent blue or green, etc.) or may be pigmented to be opaque, such as an opaque blue or green or yellow color. Such coloring of the glass panel elements can function to provide a desired aesthetic effect that may compliment a color scheme used in a work space. Glass panel elements used in different embodiments may also be configured to be different colors. For instance, some may be clear, others may be opaque, and yet others may be partially transparent and colored (e.g. a relatively see through blue color or somewhat transparent yellow color). These panels may be utilized within a frame to provide a desired aesthetic effect for a particular embodiment of the noise reduction apparatus, which may be configured as or included within furniture, a baffle, a light fixture, a partition, or other type of device that may be positioned within a work surface.

In some other embodiments, there may be a single glass panel element having holes 24 that is positioned adjacent a second panel element to define a gap 22. But, the second panel element can composed of another type of material (e.g. wood, polymeric material, etc.) or can be composed of solid glass. The second panel element may not have any holes 24 formed therein. The holes 24 of the first glass panel element and the configuration of the gap 22 (and/or the cavity defined between the first and second panels and the gap 22 and frame elements that can be configured for positioning the first and second panel elements adjacent to each other to define the gap 22) can function to provide a noise reduction that may meet a particular set of design criteria. The second panel element may be utilized to help provide a different aesthetic effect or meet some other design objective (e.g. cost of manufacture, a desired aesthetic, etc.). For some of these types of embodiments, the size of the gap 22 between the first glass panel element having holes 24 and the second panel element made of glass or other material that do not have holes can have a larger size to define a larger cavity for a greater noise reduction capacity. In yet other embodiments, there may be multiple pairs of first glass panel elements 21 having holes 24 that are spaced apart from second panel elements via gaps 22 where the second panel elements do not have holes and are composed of wood, solid glass, or other material.

Embodiments of the noise reduction apparatus can be configured to include a frame or other type of interconnection structure that helps attach a first glass panel element 21 adjacent a second glass panel element 23 to define an internal gap 22 that is in fluid communication with holes 24 formed in exterior faces of the first and second glass panel elements. The gap 22 may be defined via the interconnection structure so that the gap is open on all of its peripheral sides. Alternatively, a frame 13 that interconnects the glass panel elements can cover all of the open sides of the gap 22 or at least one of the open sides of the gap 22 (e.g. (i) just a top side, (ii) a top, a left side, and a right side, (iii) the top, the bottom, the left side, and the right side, etc.) such that the gap 22 is a cavity defined at least partially by the first and second glass panel elements.

In some embodiments, multiple first glass panel elements 21 can be connected adjacent to each other to define a structure having a first face (e.g. a front side, a left side, a right side, a top side, a bottom side, a rear side, etc.) and multiple second glass panel elements 23 can be connected adjacent to each other to define the second face of the structure that may face an opposite direction from the first face (e.g. a rear side, a right side, a left side, a bottom side, a top side, a front side, etc.). A gap 22 can be defined between the first glass panel elements 21 and the second glass panel elements 23 that is in fluid communication with the holes 24 formed in the first and second glass panel elements 21 and 23. Examples of such embodiments can be appreciated from at least FIGS. 1, 2, 3, 4, 5, 6, 7, 8, 9, 14, 15, 22, 23, and 34. A frame or other interconnection structure may be utilized to help connect the glass panel elements together to define the first and second faces (e.g. left and right faces, top and bottom faces, etc.) that are separated by a gap 22. In some embodiments, a frame can be configured so that there are multiple sets of interconnected first and second glass panel elements 21 and 23. For instance, as can be seen from FIG. 22, a frame structure can be configured so that a frame 13 is formed from multiple sets of interconnected subframe assemblies 14 that form a gap 22 between multiple first glass panel elements 21 and multiple second glass panel elements 23 having holes 24 formed therein that are in fluid communication with the gap 22 for facilitating receipt and absorption of acoustic waves traveling through air via the holes 24, glass panel elements, and gap 22. Embodiments of such a frame 13 may be utilizable in baffle configurations, wall covering configurations, shelving configurations, a privacy screen configuration, a partition wall configuration, or other configurations that may be used in furniture or in a workplace environment.

Referring to FIGS. 2 and 10-13, a noise reduction apparatus 1 can be configured as a work surface mountable noise reduction apparatus 3 that includes an assembly 20 of interconnected first and second glass panel elements 21 and 23. A frame 13 can be configured for attaching the assembly 20 adjacent a work surface. For instance, the assembly 20 can be attached to at least one tabletop 31 or an intermediate rail 33 positioned between adjacent multiple tabletops 31. The assembly 20 can be comprised of tiles 20*a* that are each defined by a subframe assembly 14 connecting a first glass panel element 21 and a second glass panel 23 to the intermediate rail 33 so that a tile 20*a* is defined by these first and second spaced apart glass panel elements. Immediately adjacent tiles 20*a* can be separated by a subframe element 14*a* that defines a side of each tile or is attached to the first and second tiles adjacent ends or sides of these tiles.

The tile 20*a* may be formed such that there is a gap 22 formed between the first and second glass panel elements 21 and 23 and the first and second glass panel elements define first and second faces of the tile 20*a*. Each subframe assembly 14 can be connected to at least one other subframe assembly 14 to interconnect the tiles into the assembly 20 of tiles and form the frame 13 that retains the tiles 20*a*. A first terminal tile connector 37 can be positioned adjacent first ends of the first and second glass panel elements 21 and 23 for attaching a first set of glass panel elements to the intermediate rail 33. A first inter-tile connector 39 can be positioned adjacent second ends of the first and second glass panel elements 21 and 23 of a first tile and first ends of first and second glass panel elements 21 and 23 of a second tile 20*a*. Multiple tiles may be arranged next to each other in such a fashion via the frame 13 for attachment to the intermediate rail 33 adjacent tabletops 31 at different locations. For instance, the second tile can have a second inter-tile connector 39 position adjacent its second ends of its first and second glass panel elements 21 and 23 for connection to the intermediate rail 33. A third tile may have its first ends of its first and second glass panel elements 21 and 23 coupled to this second inter-tile connector 39 and have the second ends of its first and second glass panel elements attached to the intermediate rail by a second terminal tile connector 37 or yet another inter-tile connector 39.

The terminal tile connectors 37 and the inter-tile connectors 39 can be configured so that a first portion 37*a*, 39*a* of the connector is received within an opening defined in a frame element 14*a* of a subframe assembly 14 of the frame 13 and a second portion 37*b*, 39*b* of the connector is received within a groove 35 of the intermediate rail 33. Fasteners may be utilized to connect the connectors to the intermediate rail and/or the connectors may provide an interference fit within the groove 35 for a sufficient connection to the intermediate rail such that fasteners are not needed for the connection to the intermediate rail 33.

The assembly 20 can also include frame elements, such as side covering elements 45 and top covering elements 43 for attachment to the tiles 20*a*. An inter-element corner connector 44 can also be positioned adjacent a terminal end of the top covering element 43 and an upper end of the side covering element 45 to interconnect these covering elements and ensure a corner gap that may exist between these elements is covered. The side and top covering elements 45 and 43 can cover the sides and tops of gaps 22 defined between the first and second glass panel elements 21 and 23 to enclose those gaps.

Figure 14:
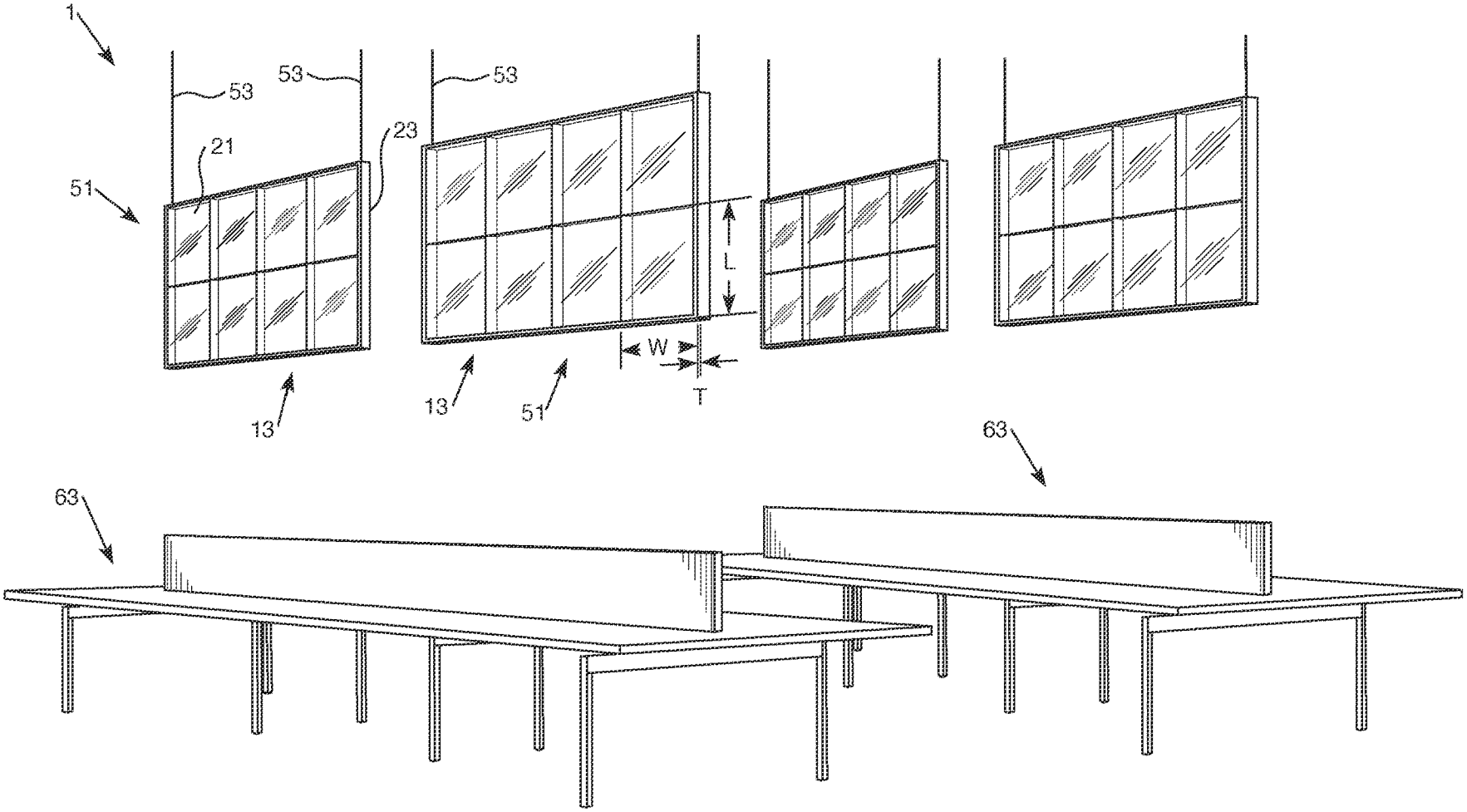
FIG. 14 is a perspective view of a tenth exemplary embodiment of the noise reduction apparatus, which is configured as a noise reduction baffle.
Figure 15:
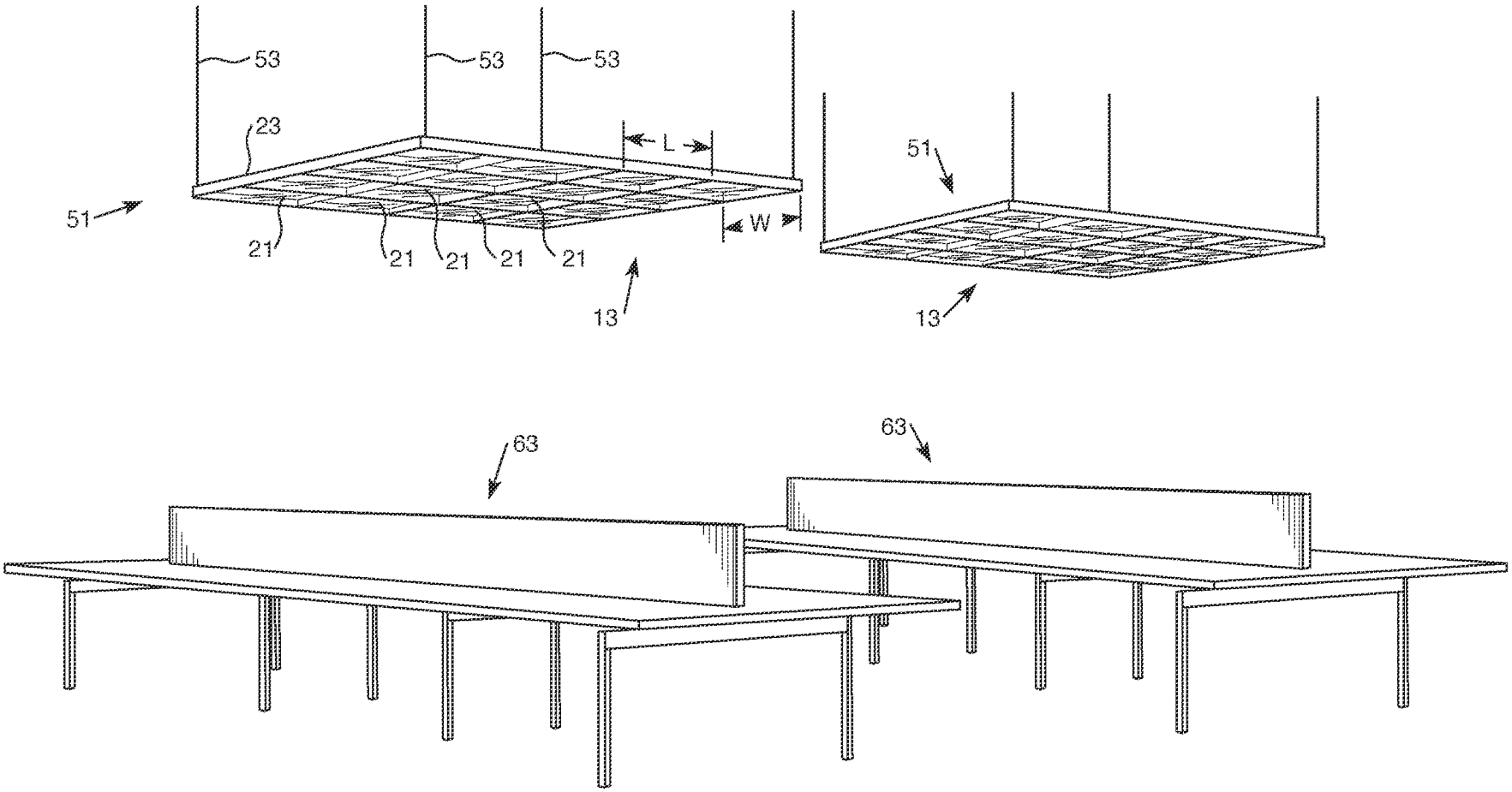
FIG. 15 is a perspective view of an eleventh exemplary embodiment of the noise reduction apparatus, which is configured as a noise reduction baffle.
Figure 16:
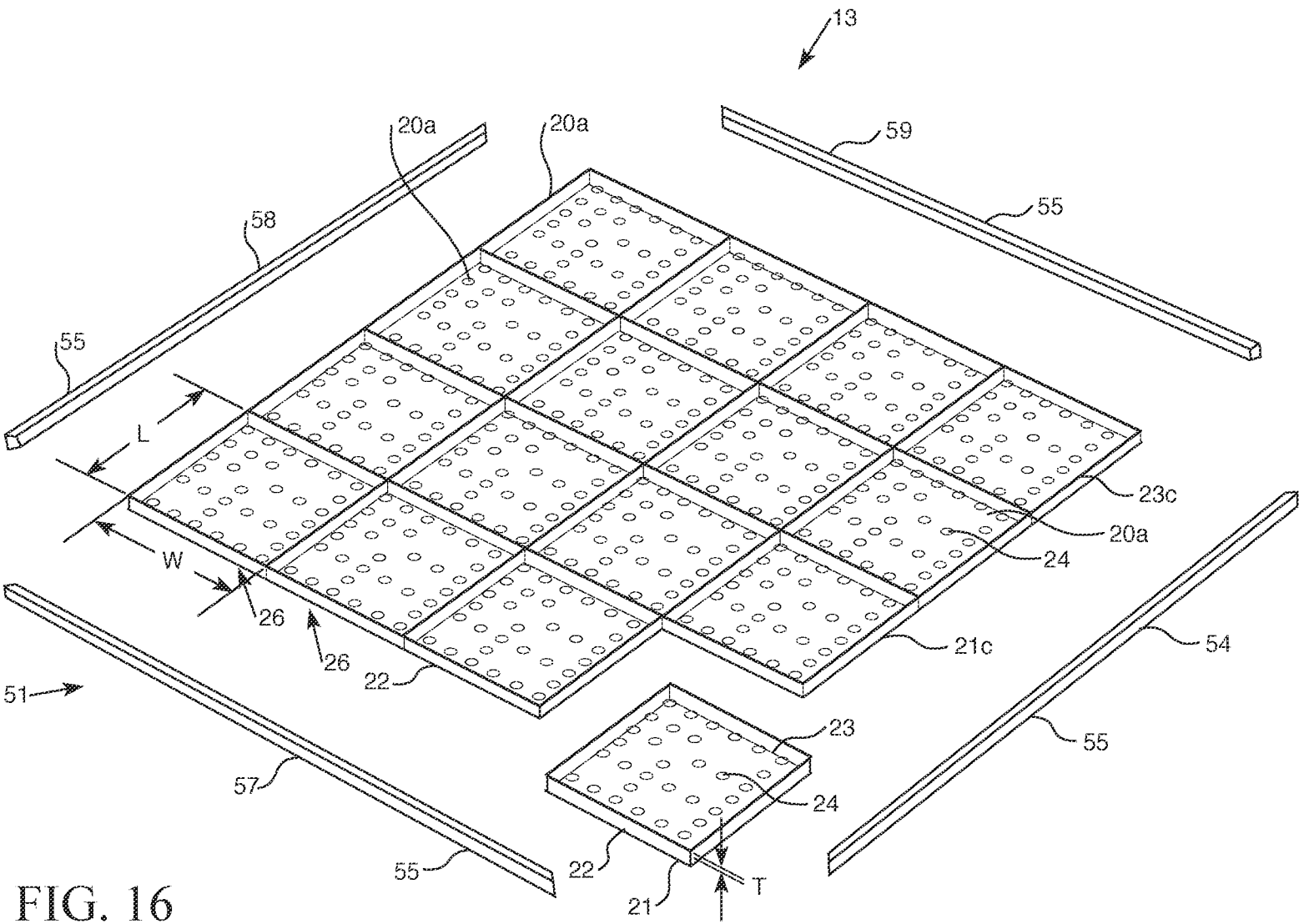
FIG. 16 is an exploded view of a frame that is utilizable in the tenth and eleventh embodiments of the noise reduction apparatus.

Referring to FIGS. 14-15, a noise reduction apparatus can be configured as a noise reduction baffle 51 that is positioned over a workspace. For instance, the noise reduction baffles 51 can be positioned over workplace furniture 63, which can include, for example, tables, desks, a group of cubicles, or other type of workspace furniture within a room or floor of an office building or other type of workspace. Each baffle 51 can be mounted to a ceiling via at least one mounting device 53. Each mounting device 53 can include a suspension wire or other type of elongated member (e.g. beam, bar, tube, rod, etc.) or other structure (e.g. bracket, bracket assembly, attachment assembly, etc.) suitable for mounting a baffle to hang from a ceiling or be suspended over a workspace at a pre-selected height (e.g. via attachment to a ceiling or via attachment to walls of a building for suspending the baffle 51 over the workspace). Each mounting device 53 can be connected to the frame 13 of the baffle 51 for positioning the baffle 51 over the work space at a desired height or desired position.

The frame 13 of each baffle 51 can be configured for hanging or mounting of the baffles in different orientations. For example, frame 13 can be configured so that the first glass panel elements 21 and the second glass panel elements 23 define a top and bottom of the baffle 51 by facing downwardly and upwardly when the baffle 51 is mounted as shown, for example, in FIG. 15.

As another example, the frame 13 can be configured so that the first glass panel elements 21 and the second glass panel elements 23 define opposite sides of the baffle 51 and face leftwardly and rightwardly when the baffle 51 is mounted as shown, for example, in FIG. 14. A bottom of each frame 13 may face downwardly and be the lowest point of the mounted baffle 51 in such embodiments.

Referring to FIGS. 16-22 and as may also be appreciated from at least FIGS. 10-13, different embodiments of frames 13 of a noise reduction apparatus can be provided for positioning the first and second glass panel elements 21 and 23 for noise reduction functionality. In some embodiments, the frame 13 can have a single subframe assembly 14. In other embodiments, the frame 13 can include multiple interconnected subframe assemblies 14. For example, a frame 13 can include elongated side frame members 55, which define an outer first side 54, second side 57, third side 58, and fourth side 59 of the frame 13. A first end of a first member defining the first side 54 can be connected to a first end of a second member defining the second side 57. A second end of the second member defining the second side 57 can be connected to a first end of a third member defining the third side 58. A second end of the third member defining the third side 58 can be connected to a first end of a fourth member defining the fourth side 59. The second end of the fourth member defining the fourth side 59 can be connected to the second end of the first member defining the first side 54.

A plurality of tiles 20*a* can be positioned within the frame 13. Prior to the members of the first, second, third, and fourth sides being interconnected so that the connection of the frame members to define the outer peripheral sides of the frame retain the tiles 20*a* within the frame. Outer edges on at least one side of each tile can be received within grooves of at least one frame member for helping to retain the tiles 20*a* within the frame 13. For instance, first glass panel elements 21 and second glass panel elements 23 can have peripheral edges 21*c*, 23*c*, that are configured to mate or be received within grooves defined in the frame members defining the first, second, third, and fourth sides of the frame 13. Each tile 20*a* can be formed by a first glass panel element 21 and a second glass panel element 23 being interconnected to define gap 22 in communication with holes 24 by a tile frame structure 26. The tile frame structure 26 may include an annular shaped structure connected adjacent the peripheral edges of the first and second glass panel elements 21 and 23. The outer sides of the tile frame structure 26 can be flush with the peripheral edges 21*c*, 23*c* of the first and second glass panel elements 21, 23 or be recesses so that the peripheral edges 21*c*, 23*c*, extend beyond the outermost sides of the tile frame structure 26. Each tile 20*a* can be interconnected to other tiles within the frame 13 via fasteners or other type of interconnection mechanism attached between the tile frame structures of those tiles 20*a*. In some embodiments, peripheral tiles that are positioned immediately adjacent the side members of a frame 13 may be connected to two or three immediately adjacent tiles 20*a*. Inner tiles 20*a* that are positioned inside of the peripheral tiles 20*a* can be connected to four different immediately adjacent tiles within the frame 13. Such inter-tile connections within the frame 13 can help improve the strength of the attachment of the tiles 20*a* to the side members of the frame 13. Of course, interconnection mechanisms may also be used for connecting the peripheral tiles 20*a* to the frame side members that define the different sides of the frame as well to supplement any attachment provided via the receipt of the edges 21*c*, 23*c*, within the frame members.

As can be seen from FIGS. 17-22, a frame 13 can also be comprised of a plurality of subframe assemblies 14. Each subframe assembly 14 may be configured to form a panel 28 of a noise reduction apparatus that may be formed from multiple first glass panel elements 21 and multiple second glass panel elements 23 being positioned away from each other to form a large gap 22 that may be configured as a channel or cavity that is in communication with the holes 24 of the first and second glass panel elements of the panel 28. The formed gaps can extend between a plurality of first glass panel elements 21 and a plurality of second glass panel elements 23 to define a cavity for sound absorption of sound waves received therein via the holes 24 that may be larger in volume and larger in area than the gap 22 that is defined by only a single first glass panel element 21 and a single second glass panel element 23 of a tile 20*a*.

Figure 17:
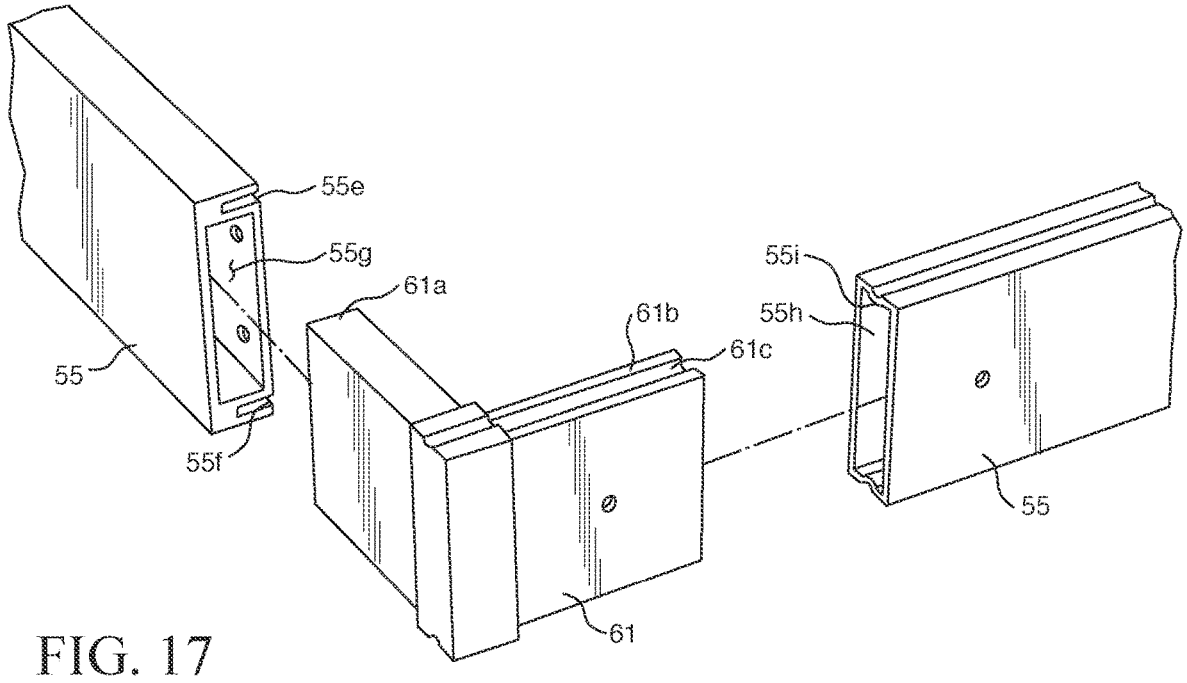
FIG. 17 is a fragmentary exploded view of the frame that is utilizable in the tenth and eleventh embodiments of the noise reduction apparatus.
Figure 18:
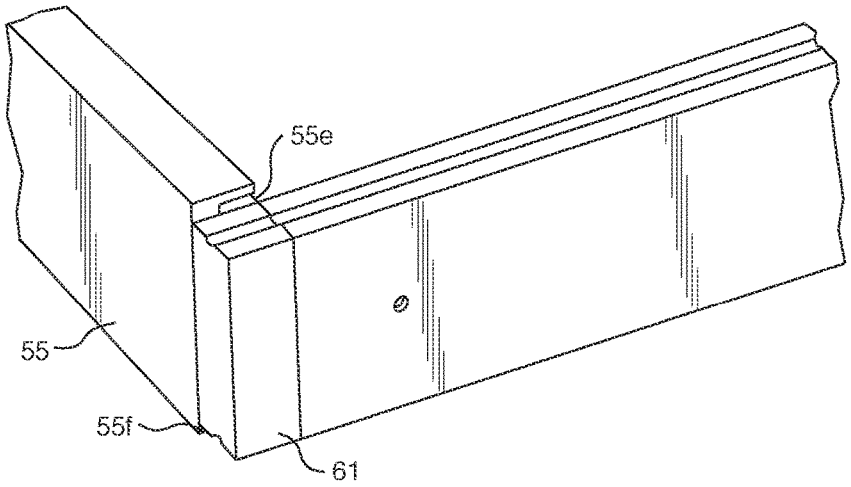
FIG. 18 is a fragmentary view of the frame that is utilizable in the tenth and eleventh embodiments of the noise reduction apparatus.
Figure 19:
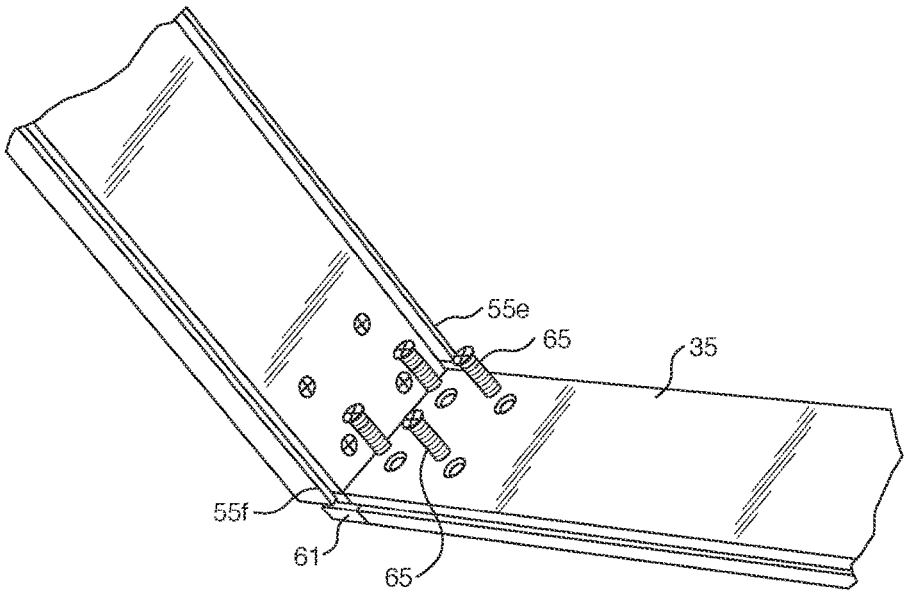
FIG. 19 is a fragmentary view of the frame that is utilizable in the tenth and eleventh embodiments of the noise reduction apparatus.
Figure 20:
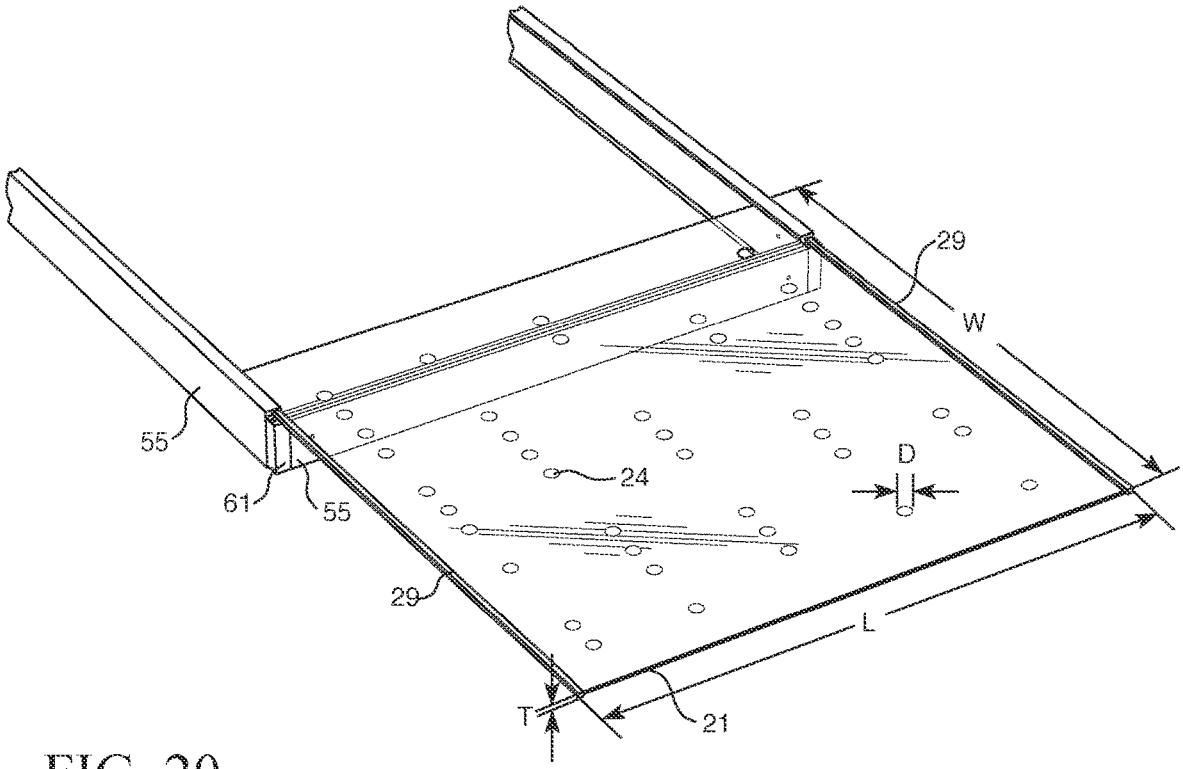
FIG. 20 is a fragmentary view of a frame that is a fragmentary view of the frame that is utilizable in the tenth and eleventh embodiments of the noise reduction apparatus to illustrate how glass panel elements can be positioned within the frame and/or attached to the frame.
Figure 21:
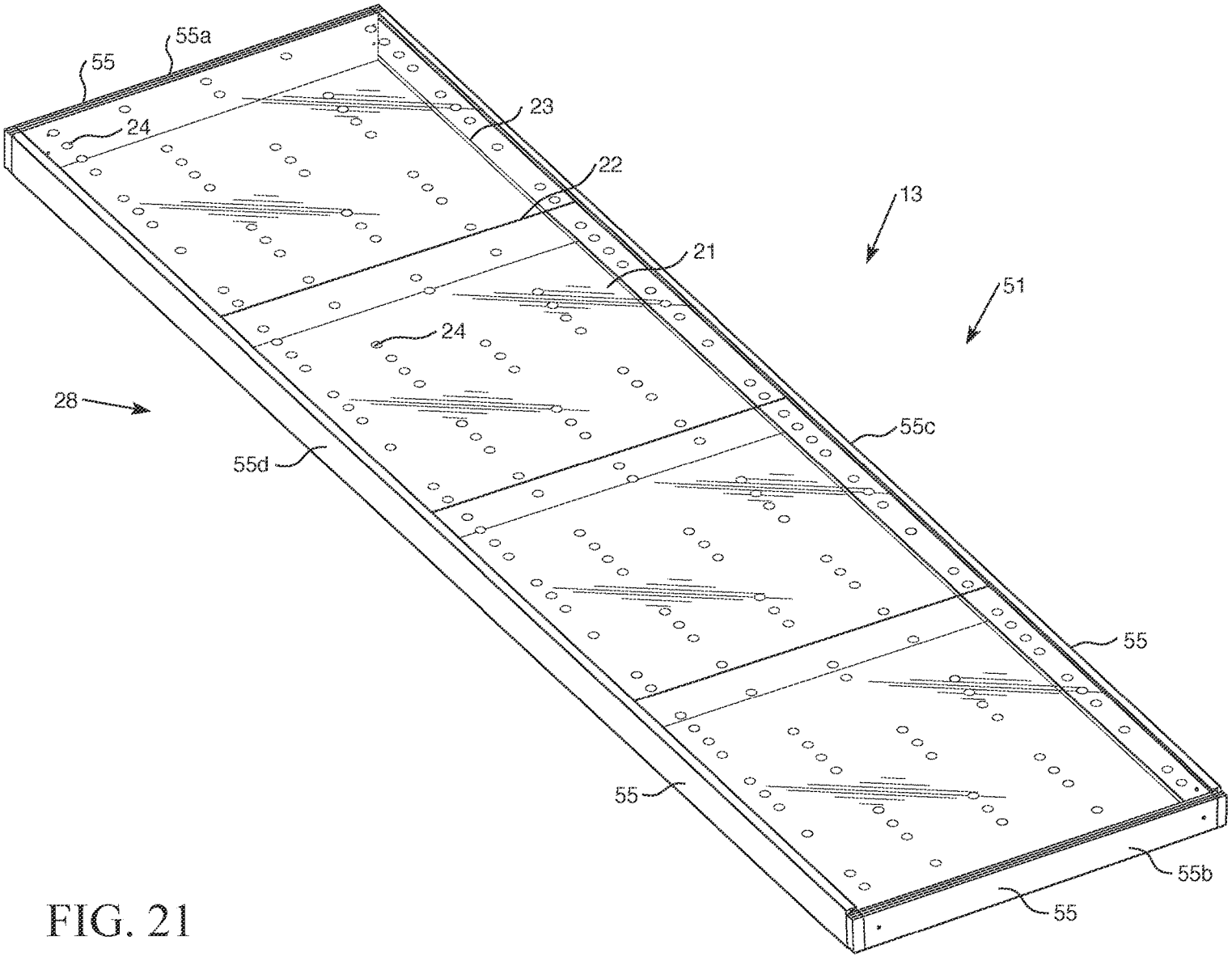
FIG. 21 is a fragmentary view similar to FIG. 20, which illustrates how glass panel elements can be positioned within the frame and/or attached to the frame that is utilizable in the tenth and eleventh embodiments of the noise reduction apparatus.

The formation of each panel 28 in some embodiments can be appreciated from FIGS. 17-21. Each subframe assembly 14 that define a panel 28 can include side frame members 55 that are attached together to define a polygonal shape (e.g. rectangular shape, etc.). A first side member 55*a* can be opposite a second side member 55*b*. A third side member 55*c* can be opposite a fourth side member 55*d*. The first and second side members 55*a* and 55*b* may be between the third and fourth side members 55*c* and 55*d*. Opposite ends of the first side member 55*a* can be attached to first ends of the third and fourth side members 55*c* and 55*d*. Opposite ends of the second side member 55*b* can be attached to second ends of the third and fourth side members 55*c* and 55*d*. Corner connectors 61 can be positioned for providing these connections as shown in FIGS. 17-19.

For example, a corner connector 61 can have a body that has a first projection 61*a* that is sized to be received within a first opening 55*g* of a third side member 55*c* and/or fourth side member 55*d* and a second projection 61*b* that is sized for being received within an opening 55*h* of the first side member 55*a* and/or second side member 55*b*. The openings 55*g* and 55*h* may be at the ends of each side frame member 55 to facilitate end-to-end connections. Each projection of the corner connector 61 may be a groove of protuberance that is to mate with a protuberance or groove defined within an opening 55*g* or 55*h* of a side member 55. For example, a corner connector 61 may have a groove 61*c* for mating with a protuberance 55*i*. Fasteners 65, such as bolts or screws, can also be used to help fasten the first projection 61*a* to the third or fourth side member 55*c*, 55*d* within the opening 55*g* and the second projection 61*b* to the first or second side member 55*a*, 55*b* within opening 55*h*. In some embodiments, the side members may have holes therein that are to align with holes in the projections for facilitating interconnection of the side members via the corner connectors 61 and receipt of fasteners 65.

The first and second side members 55*a* and 55*b* may be less wide than the third and fourth side members 55*c* and 55*d* so that they do not cover or close off spaced apart parallel first and second grooves 55*e* and 55*f* that are defined in the third and fourth side members 55*c* and 55*d*.

The first glass panel elements may be attached to the subframe assembly 14 via the parallel and aligned first grooves 55*e* of the third and fourth side members 55*c* and 55*d*. The second glass panel elements may be attached to the subframe assembly 14 via the parallel and aligned second grooves 55*f* of the third and fourth side members 55*c* and 55*d*. Edges 21*c*, 23*c* of the glass panel elements may have strips 29 attached thereto to help facilitate sliding and attachment of the glass panel elements to the third and fourth side members 55*c* and 55*d* via the first and second grooves 55*e* and 55*f*. A plurality of first and second glass panel elements may be slid via the first and second grooves 55*e* and 55*f* into position to define gaps 22 between opposed first and second glass panel elements 21 and 23 so that the gaps are in communication with each other and define a cavity for forming a panel 28.

Figure 22:
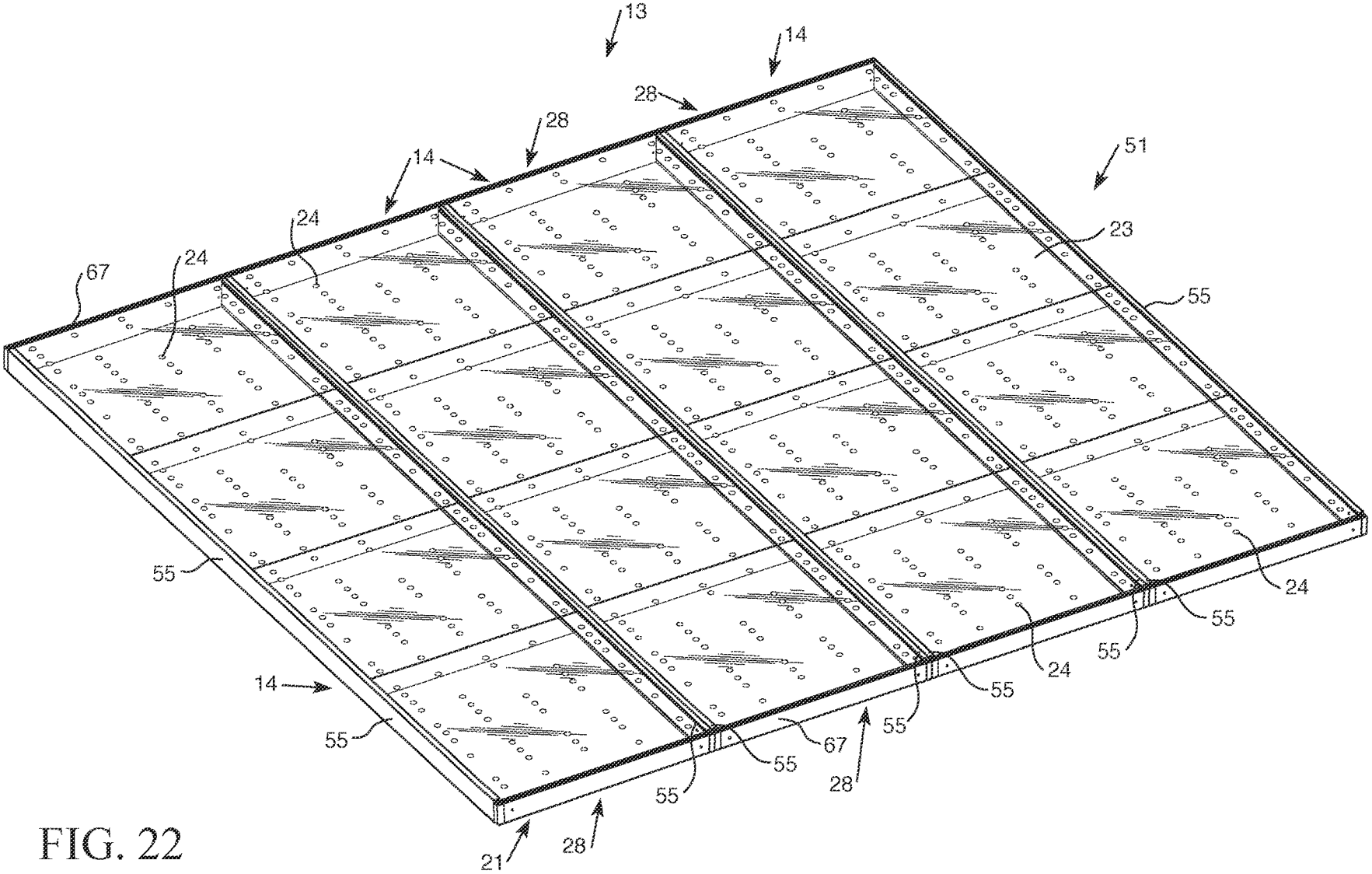
FIG. 22 is a perspective view of the frame that is utilizable in the tenth and eleventh embodiments of the noise reduction apparatus.
Figure 23:
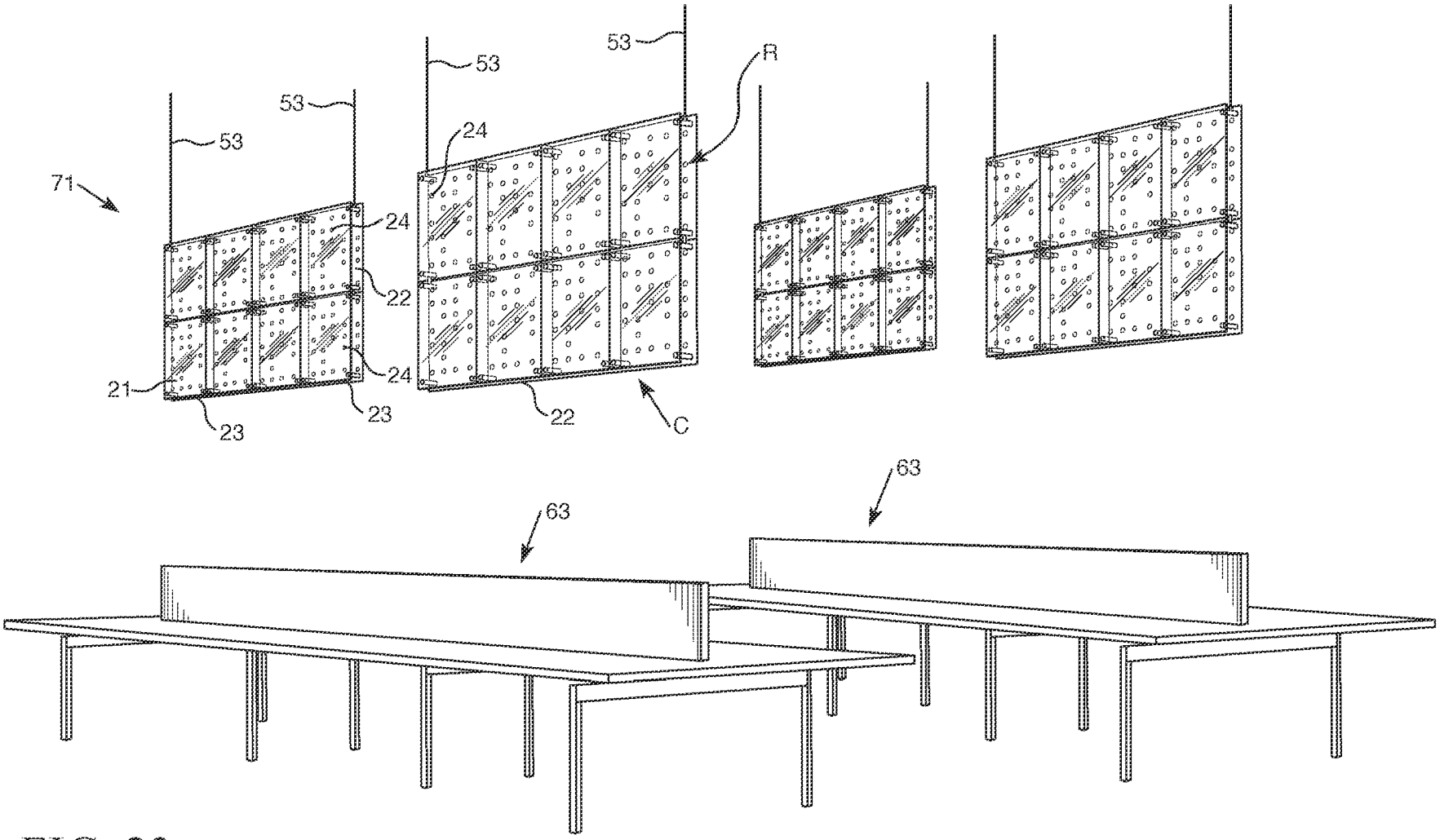
FIG. 23 is a perspective view of a twelfth exemplary embodiment of the noise reduction apparatus, which is configured as a baffle.
Figure 24:
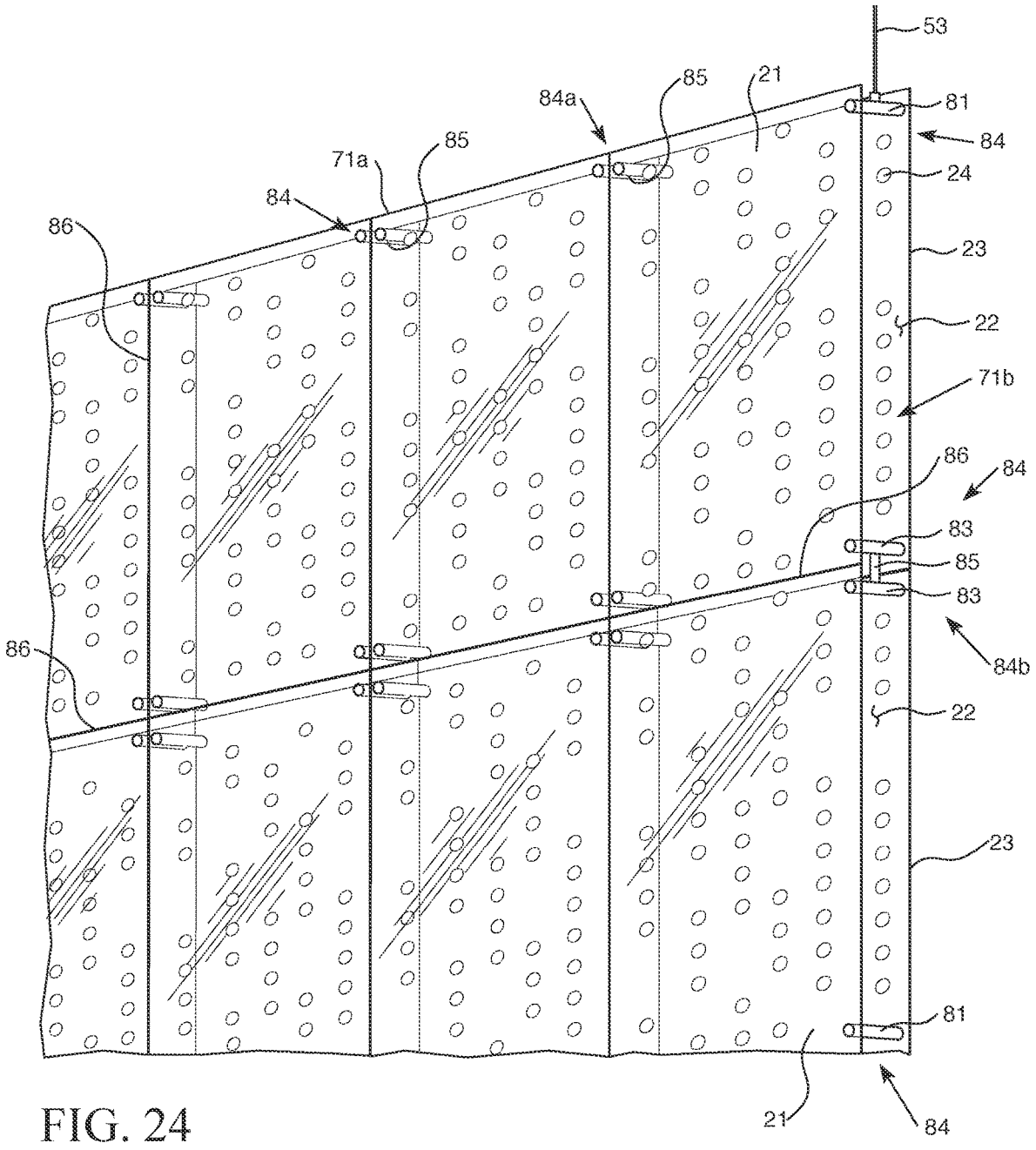
FIG. 24 is a fragmentary view of an upper end section of the twelfth exemplary embodiment of the noise reduction apparatus.
Figure 25:
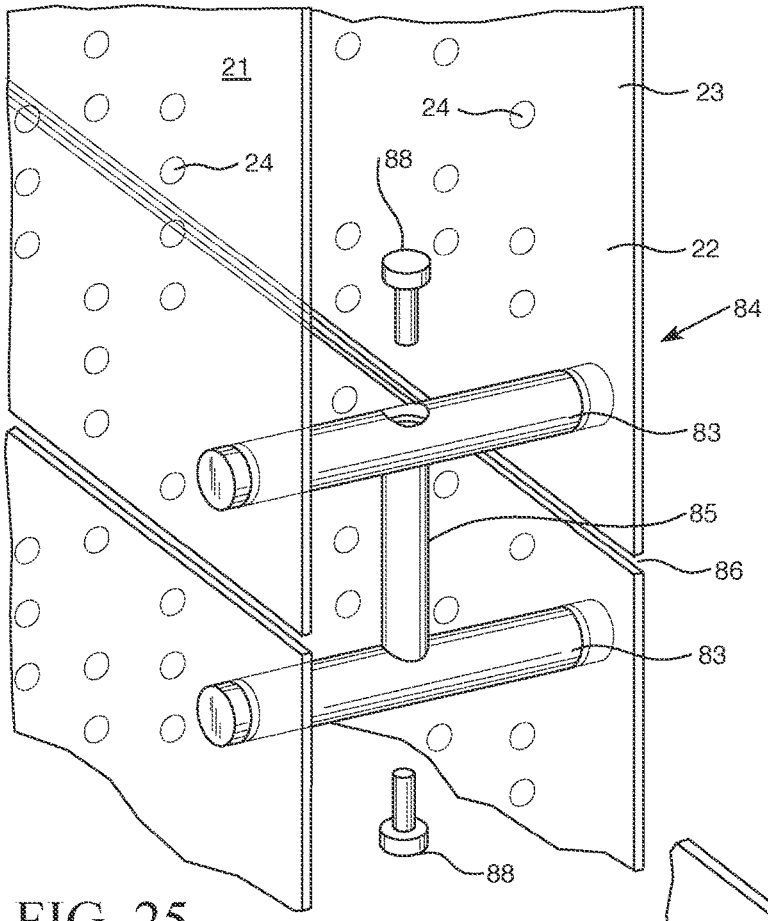
FIG. 25 is an exploded view of a middle side portion of the twelfth exemplary embodiment of the noise reduction apparatus.
Figure 26:
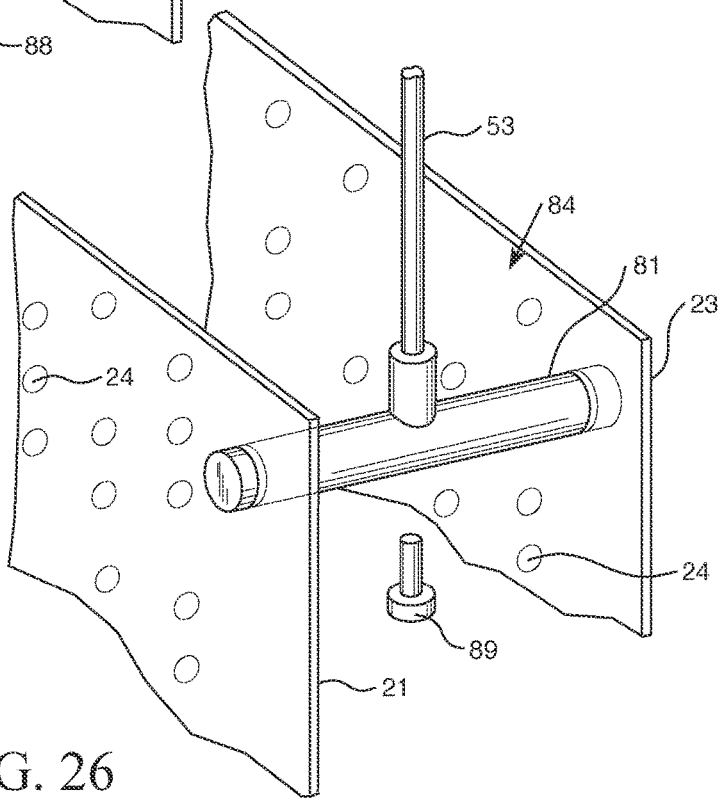
FIG. 26 is an enlarged fragmentary view of a top end section of the twelfth exemplary embodiment of the noise reduction apparatus.
Figure 27:
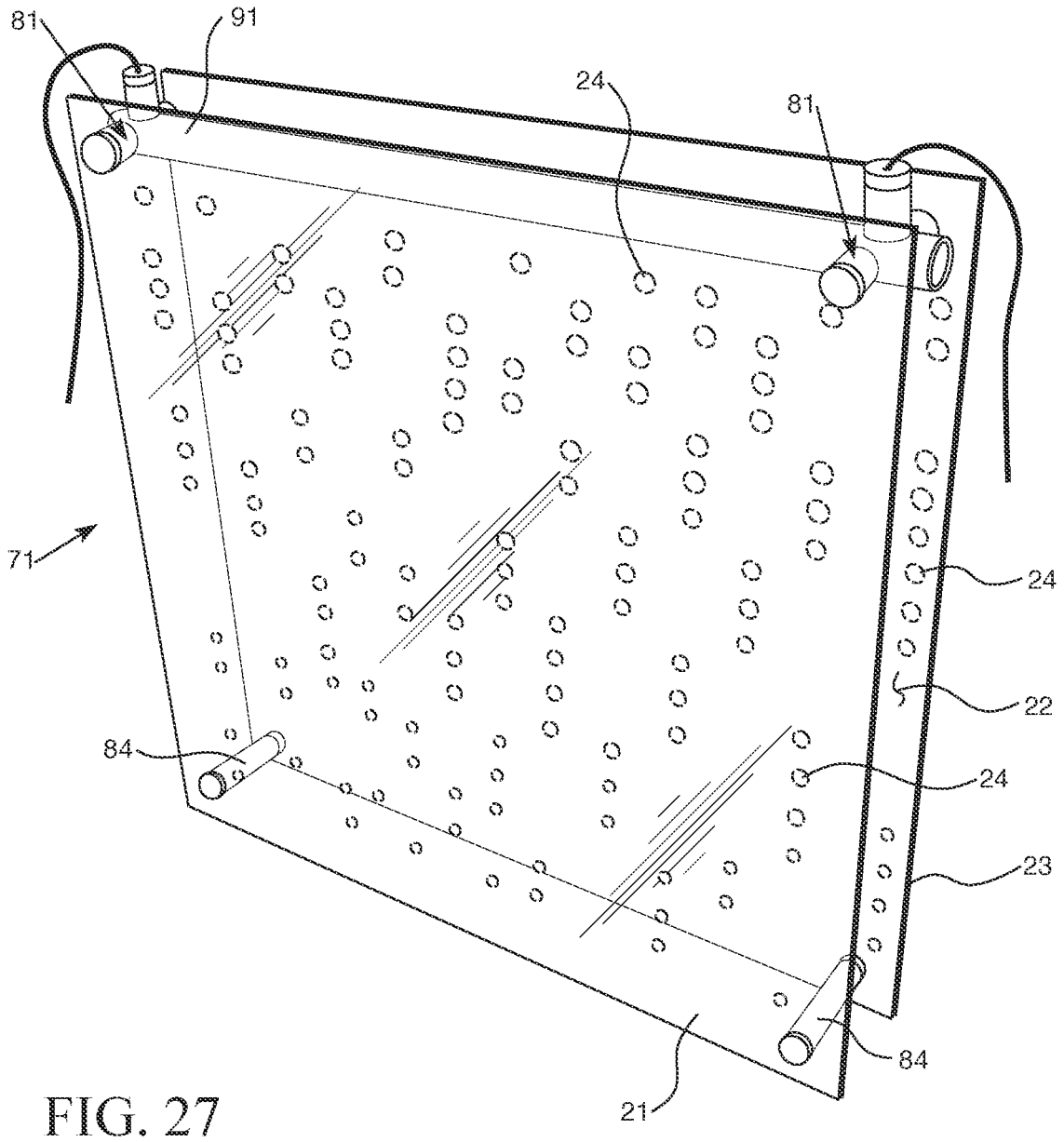
FIG. 27 is a perspective view of a thirteenth exemplary embodiment of the noise reduction apparatus, which is configured as a baffle in which the glass panel elements 21 and 23 can optionally have holes (24) shown in broken line in FIG. 27).
Figure 28:
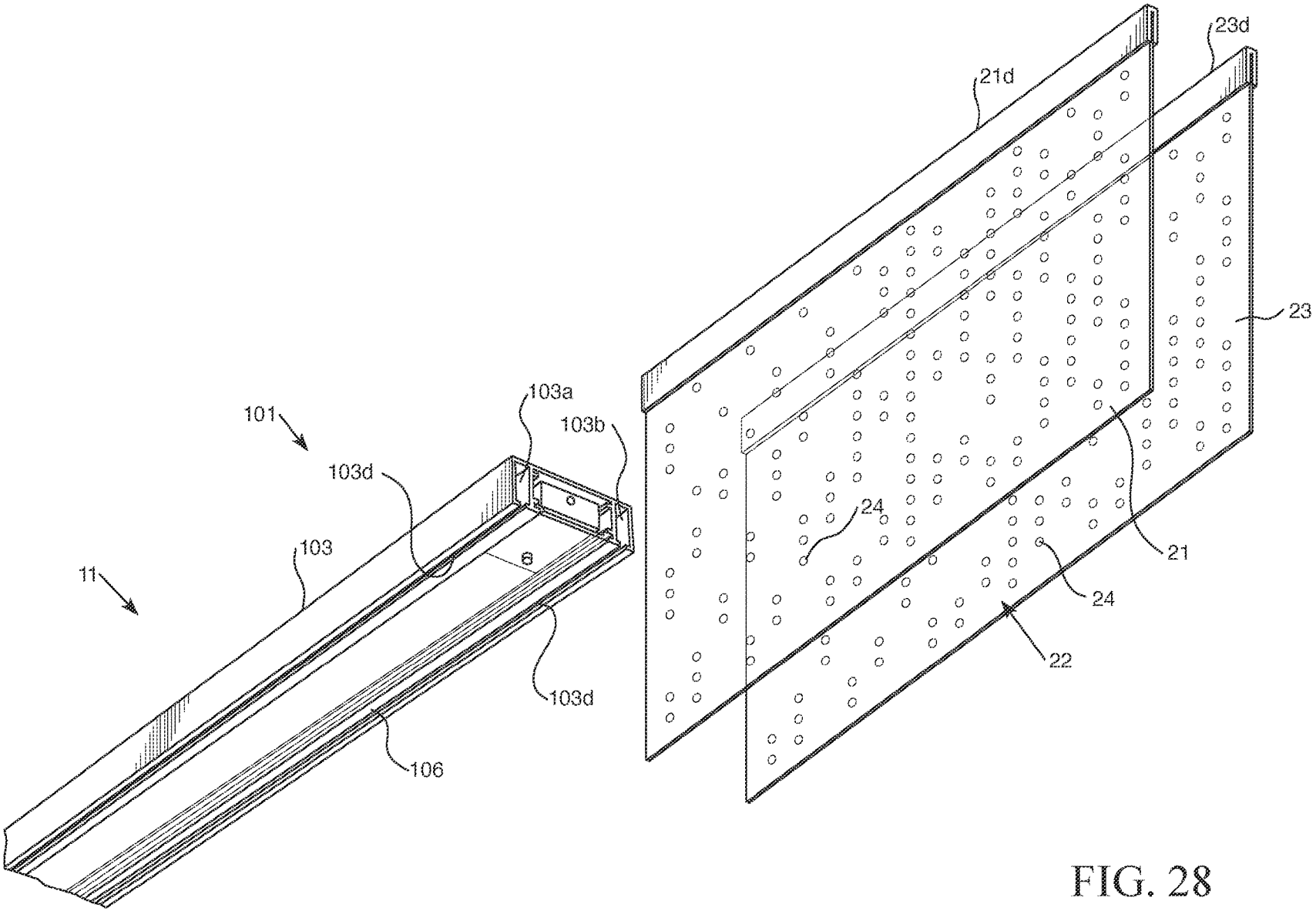
FIG. 28 is an exploded fragmentary view of the eighth exemplary embodiment of the noise reduction apparatus.
Figure 29:
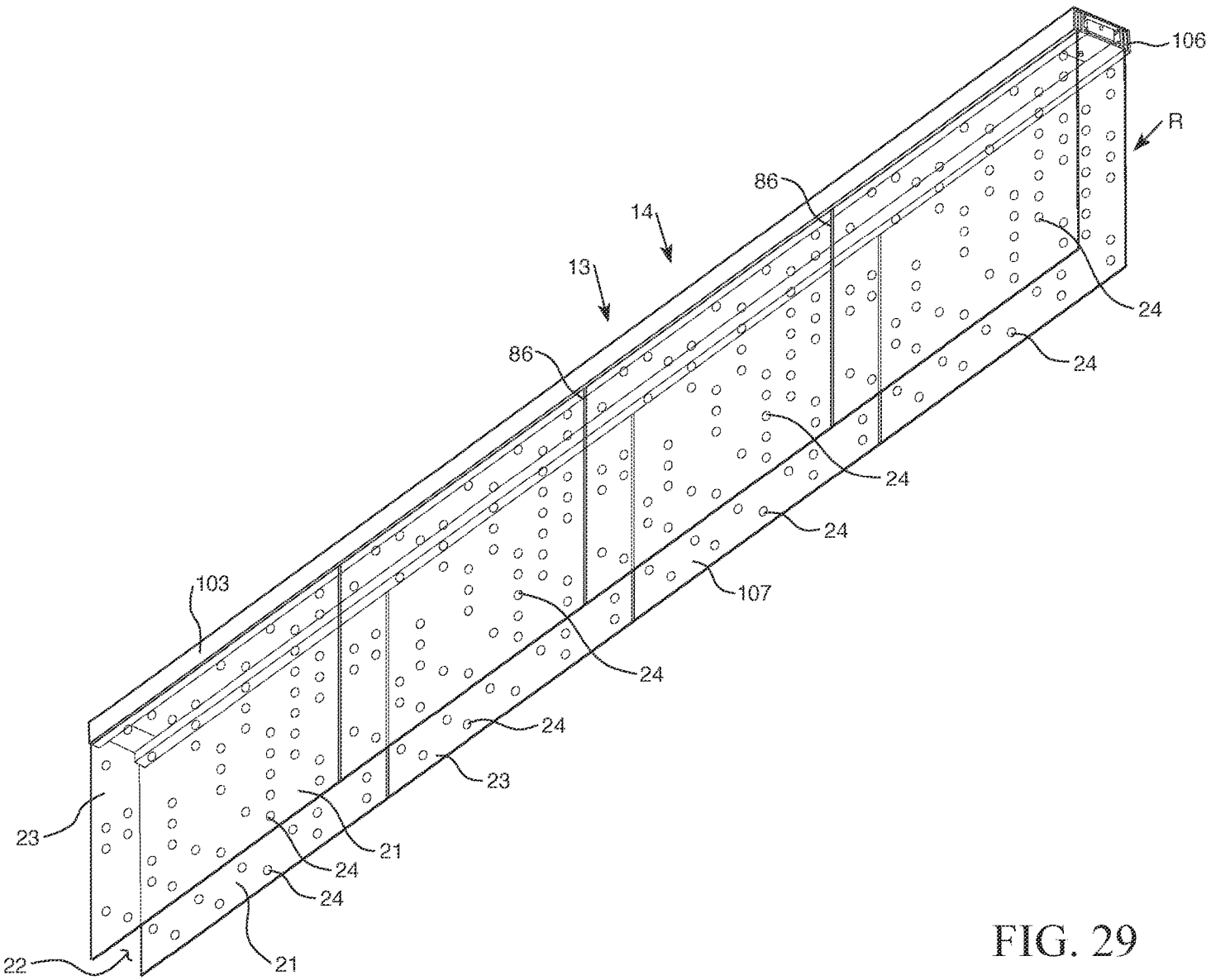
FIG. 29 is a fragmentary view of the eighth exemplary embodiment of the noise reduction apparatus.
Figure 30:
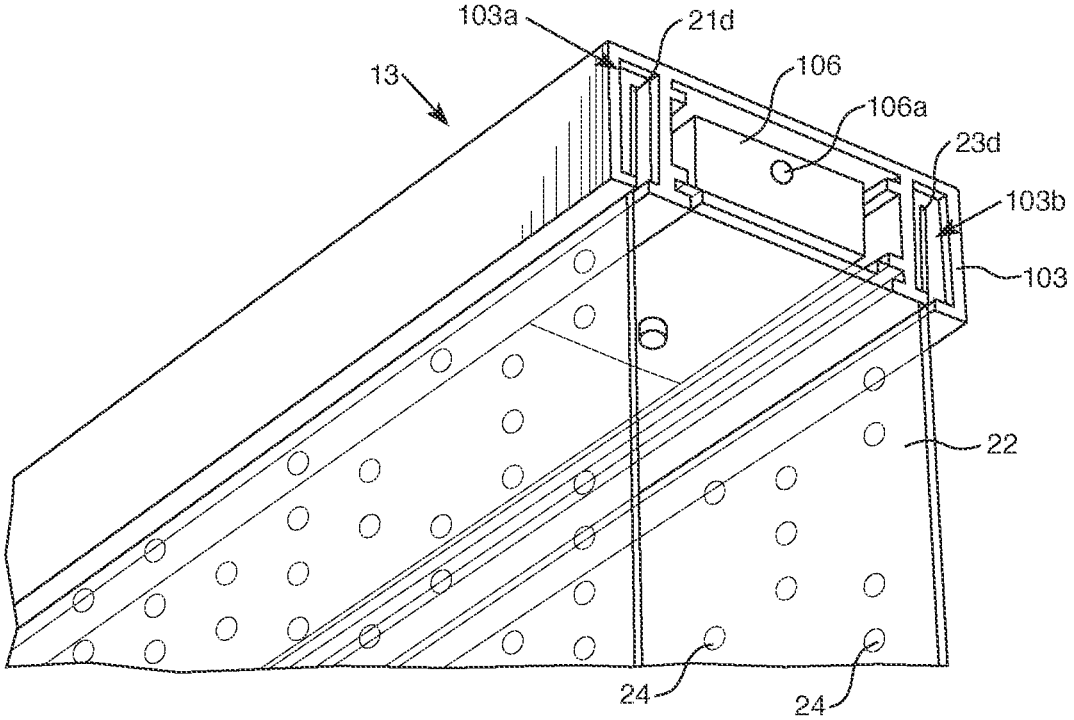
FIG. 30 is an enlarged fragmentary view of an upper end of the eighth exemplary embodiment of the noise reduction apparatus.
Figure 31:
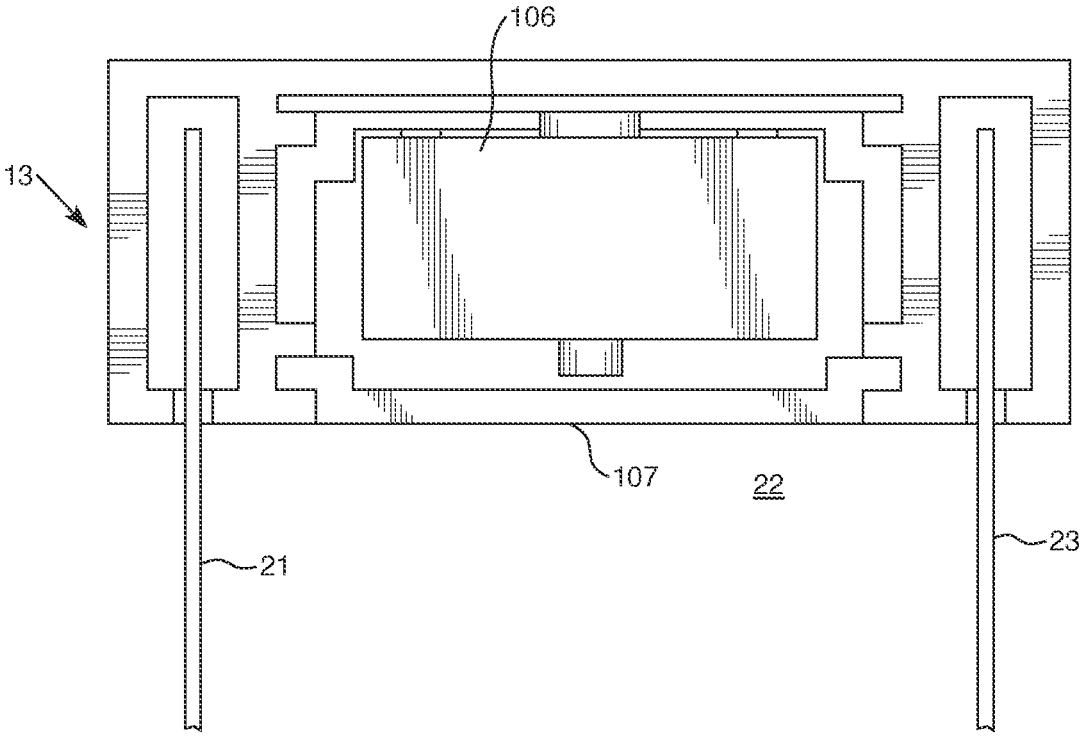
FIG. 31 is a cross-sectional view of the eighth exemplary embodiment of the noise reduction apparatus.
Figure 32:
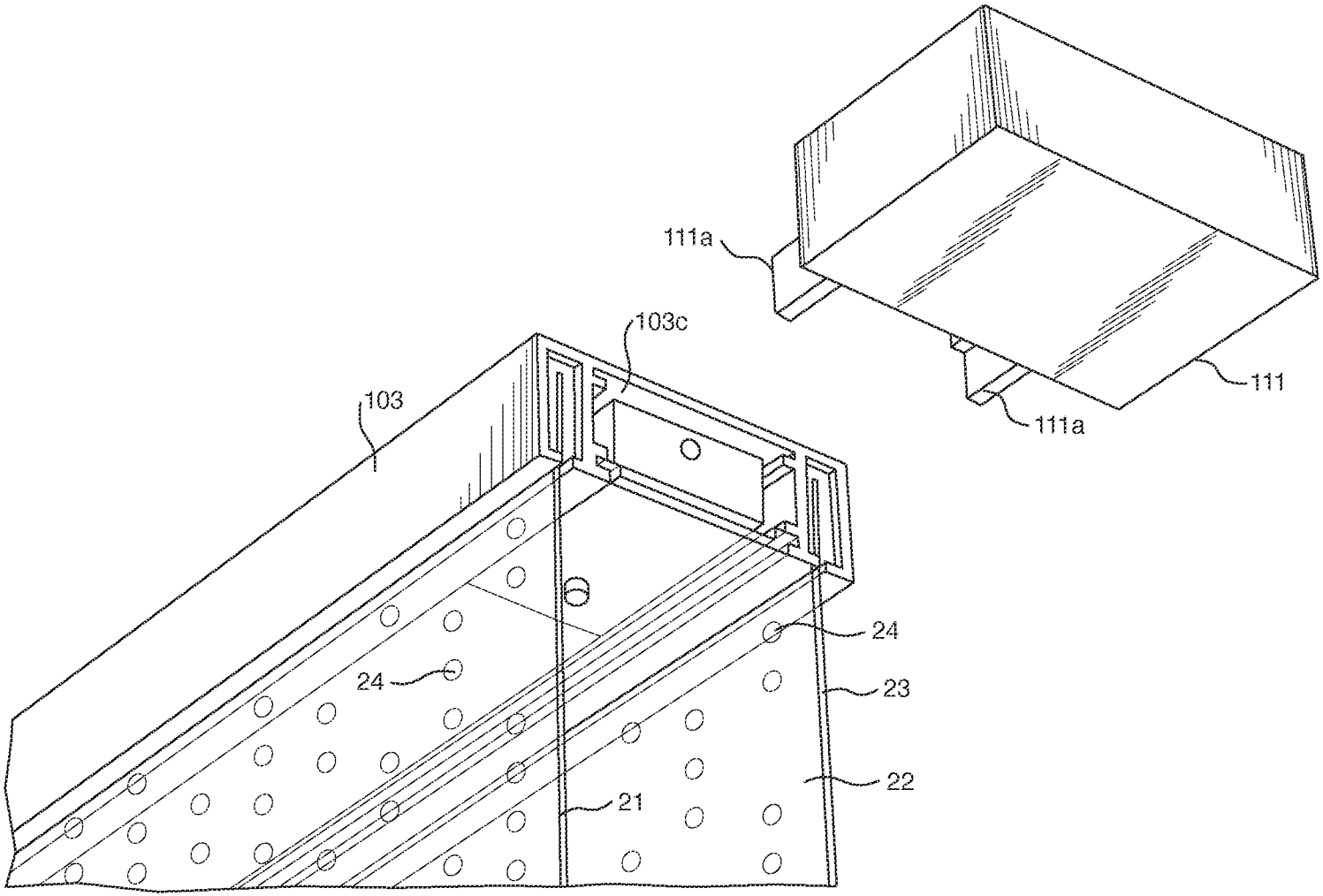
FIG. 32 is an exploded fragmentary view of the eighth exemplary embodiment of the noise reduction apparatus illustrating an upper end of the embodiment.
Figure 33:
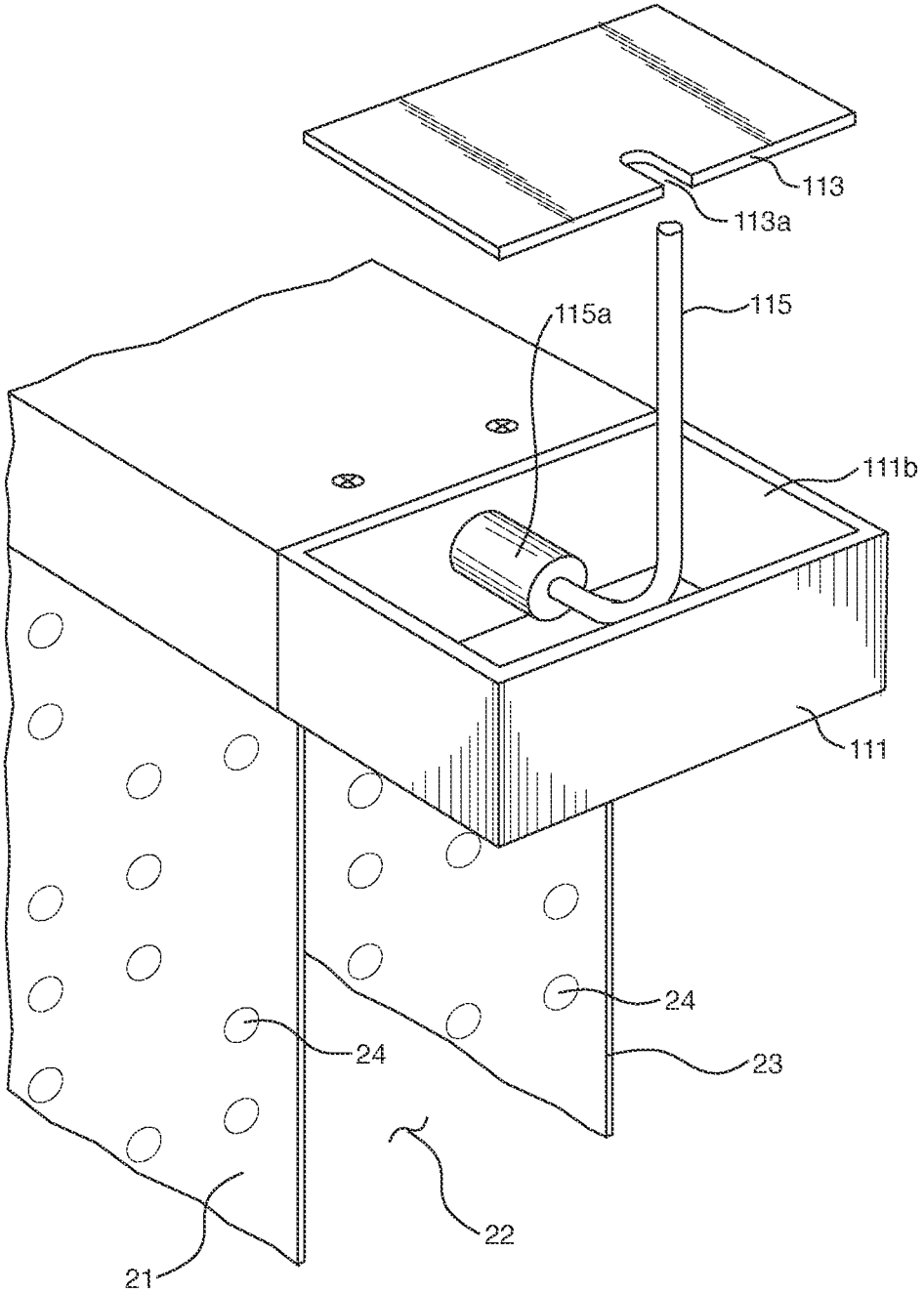
FIG. 33 is an exploded fragmentary view of the eighth exemplary embodiment of the noise reduction apparatus illustrating an upper end of the embodiment.
Figure 34:
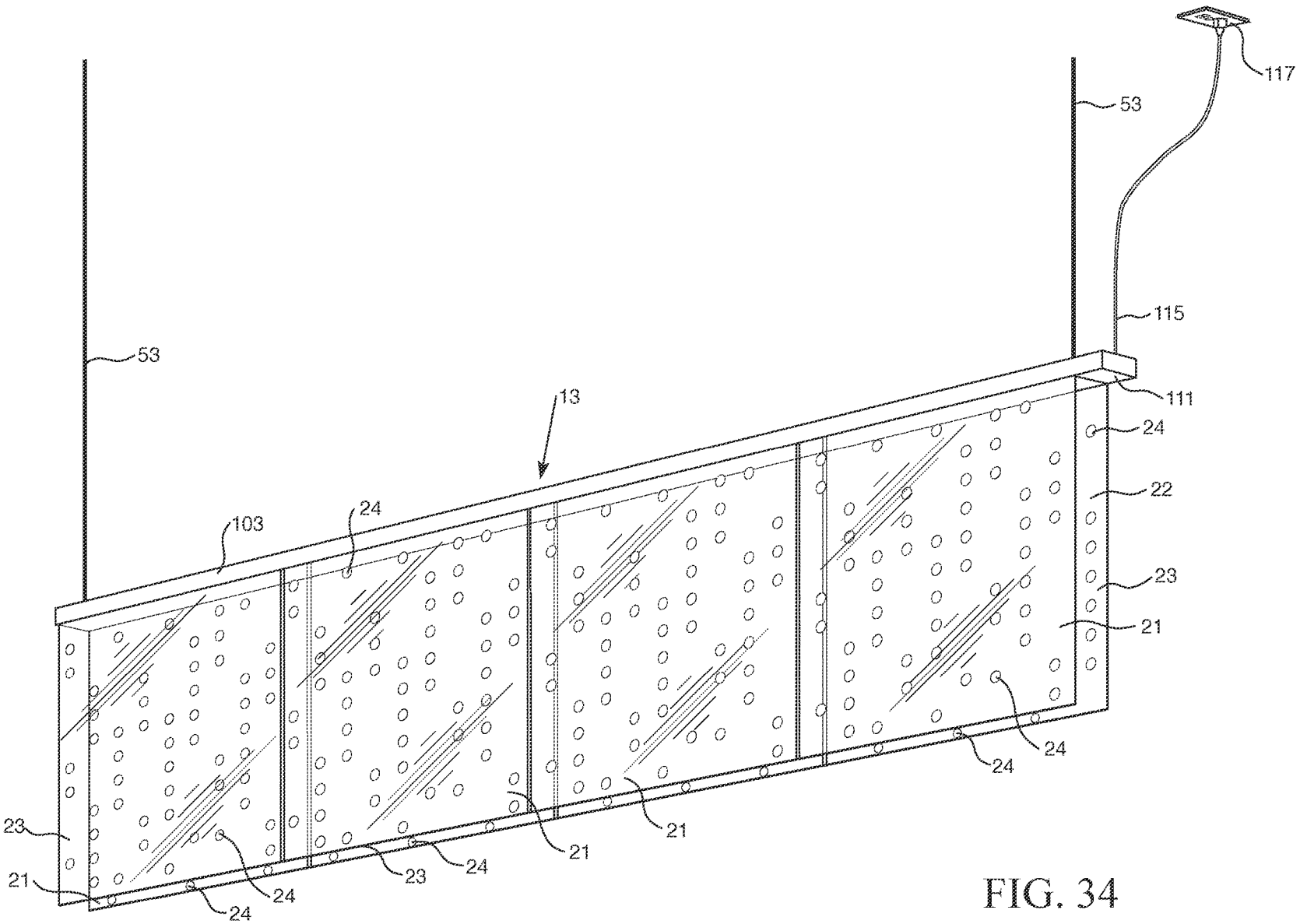
FIG. 34 is a perspective view of the eighth exemplary embodiment of the noise reduction apparatus.

As may be seen from FIG. 22, each formed panel may be arranged in series so that it is immediately adjacent to at least one other panel. The panels 28 may then be interconnected together. Such an interconnection can be provided by covering members 67 that are attached to outer sides of the first side members 55*a* and second side members 55*b* to cover the ends of the first and second grooves 55*e* and 55*f* of the third and fourth side members 55*c* and 55*d*. A first cover member 67 can be an elongated member that extends along multiple aligned first side members 55*a* for fastening to those members via fasteners and/or interlocking or mateable profiles defined in the interior face of the member. A second cover member 67 can be an elongated member that extends along multiple aligned second side members 55*b* for fastening to those members via fasteners and/or interlocking or mateable profiles defined in the interior face of the member. Each covering member 67 can include parallel spaced apart grooves for receiving a peripheral edge of first and second glass panel elements 21 and 23 as well. In other embodiments, the peripheral edges of the first and second glass panel elements 21 and 23 adjacent the first and second side members 55*a* and 55*b* may be flush with ends of the first and second grooves 55*e* and 55*f* or be retained within those grooves by the covering members 67 blocking the open ends of these grooves.

Of course, the subframe assemblies may also be interconnected to each other by other mechanisms. For instance, each third side member 55*c* of a subframe assembly may be connected via fasteners or other type of attachment mechanism (e.g. adhesive, interlocking profile, etc.) with a fourth side member 55*d* of an immediately adjacent subframe assembly 14 for interconnecting the panels 28 between the first and second covering members 67.

Referring to FIGS. 23-27, other embodiments of the noise reduction apparatus that can be configured as baffles 71 so that the first and second glass panel elements are connected together to form gaps 22 that have open peripheral edges in communication with the air of a room or workspace in which the apparatus is positioned. The first and second glass panel elements 21 and 23 can be connected together by a plurality of connectors 84 positioned within the gap 22. The connectors 84 can include mounting device connectors 81, vertically aligned glass panel element connectors 84*b*, and horizontally aligned glass panel element connectors 84*a*. The connectors 84 can be configured to form a baffle 71 that has a plurality of interconnected first and second glass panel elements 21 and 23.

The vertically aligned glass panel element connectors 84*b* and the horizontally aligned glass panel element connectors 84*a* can include elongated members 83 that are positioned in a gap 22 and extend between a first glass panel element 21 and a second glass panel element 23 for attaching those panel elements together to help define the gap 22. An interconnection member 85 can extend between the elongated members 83 that are within gaps 22 defined between different sets of first and second glass panel elements 21 and 23 for interconnecting the immediately adjacent glass panel elements together. The elongated members 83 and the interconnection member 85 can be rods, pipes, tubes, bars, beams, or other type of member. The interconnection members 85 can be connected to spaced apart elongated members 83 via fasteners 88 (e.g. pins, screws, bolts, rivets, etc.) and/or interlocking profiles or mating profiles. In some embodiments, the interconnection member 85 of a connector can extend from a portion of a first elongated member 83 that is within a gap 22 defined between a first pair of first and second glass panel elements to a second elongated member 83 that is within another gap defined between a second pair of first and second glass panel elements that are immediate adjacent the first pair (e.g. immediately below, above, to the left, or to the right of the first pair). The positioning of the immediately adjacent pairs of first and second glass panel elements can be configured so that spaces 86 are defined between the immediately adjacent pairs. The spaces 86 can be defined between different rows R of pairs of glass panel elements. The spaces 86 can also be defined between immediately adjacent columns C of glass panel elements.

The mounting device connectors 81 can be positioned within gaps 22 defined between upper pairs of first and second glass panel elements within an upper row of such pairs. Each mounting device connector 81 can be within a gap 22 and extend from a first glass panel element 21 to an opposing spaced apart second glass panel element 23. A portion of the body of the mounting device connector 81 can be configured to receive a terminal portion of a mounting device 53. For instance, a portion of the body of the mounting device connector 81 can be a middle or central portion of the body that has a hole or profile defined therein for matingly or interlockingly receiving a lower terminal end portion of a mounting device 53 that may extend from the mounting device connector 81 to a ceiling, a wall, or other structure for positioning the baffle 71 above a workspace. A fastening mechanism 89 (e.g. a fastener such as, for example, a screw or bolt, that extends through a body of the mounting device connector 81 to a terminal end portion of the mounting device 53) can also be utilized to connect the mounting device 53 to the mounting device connector 81. There may only be one the mounting device connector 81 for a baffle 71 or there may be more than one such connector. In some embodiments, there will at least be two such connectors adjacent opposite upper ends of the baffle 71. In yet other embodiments, there may be more than two mounting device connectors within an upper row R of pairs of first and second glass panel elements 21 and 23 of such a baffle (e.g. a first mounting device connector 81 adjacent a first end, a second mounting device connector 81 adjacent a second end, and at least one third mounting device connector 81 between the first and second mounting device connectors 81).

It is also contemplated that different connectors 84 used to interconnect a pair of first and second glass panel elements 21 and 23 together to define a gap 22 therebetween can be interconnected vi an interconnection member 91 that may extend from a body of a first connector to a body of a second connector within the gap 22. An example of such a connector interconnection member 91 can be seen in FIG. 27. The interconnection member 91 may be an elongated member (e.g. a beam, rod, pipe, bar, rail, etc.) or other type of member.

Referring to FIGS. 8-9 and 28-34, embodiments of the noise reduction apparatus can also be configured as a light fixture or incorporated into a lighting device or lighting fixture. For instance, a noise reduction apparatus 101 can be a portion of a light fixture or configured as a light fixture as shown in FIGS. 28-34. An upper frame element 103 of a frame 13 of the light fixture can be configured to retain a light emitting device 106 therein. The light emitting device 106 may include a halogen light bulb, one or more light emitting diodes, or other type of light emitting mechanism that is configured to be electrically coupled to an electrical source (e.g. an outlet, a battery, a generator, etc.). The upper frame element 103 can be configured as a rail in some embodiment.

The body of the upper frame element 103 can be configured to retain the light emitting device 106 within a central opening and define frontward and rearward grooves 103*a* and 103*b* adjacent the front and rear sidewalls of the frame element 103. Each groove may have a downwardly facing mouth 103*d* in communication with groove though which a portion of a glass panel element can extend from the upper frame element 103. At least one terminal end of each groove may also be configured so that a glass panel element is slideable within the groove by inserting an upper edge of the glass panel element into the groove via the open terminal end of the groove for positioning one or more glass panel elements within the groove. Each upper edge can be attached to a strip to help facilitate an interference fit within the groove and/or slideable positioning of the upper edge of the glass panel element within the groove.

For example, each first glass panel element 21 may have its upper edge 21*d* positioned within the first groove 103*a* of the upper frame element 103 and slid along the groove to a desired position. Each second glass panel element 23 may have its upper edge 23*d* positioned within the first groove 103*b* of the upper frame element 103 and slid along that groove to a desired position to define a gap 22 between that second panel element and a corresponding first glass panel element 21. A plurality of first and second glass panel elements may be so positioned so that multiple pairs of first and second glass panel elements 21 and 23 are attached to the upper frame element 103 via the upper frame element 103 in a row R of such pairs. The positioning of immediately adjacent pairs of first and second glass panel elements can be configured so that a space 86 is defined between immediately adjacent pairs within the row R. The gaps of the pairs of first and second glass panel elements may define a cavity or channel that is able to receive sound via the holes 25 and downwardly facing mouth of the gaps 22 for sound absorption via the glass panel elements and space defined tberebetween the first and second glass panel elements.

An open terminal end of the upper frame element 103 can have a portion 106*a* of the light emitted device 106 positioned therein that is configured for coupling to a power cord or other type of electrical conduit (e.g. power cord, electrical wiring, etc.). The end portion of the upper frame element 103 can be configured to define a profile for receiving and end cap element 111 that is configured to block the open end of the first and second grooves 103*a* and 103*b* and provide a corresponding aperture through which a portion of a power cord is passable for connection to the light emitting device 106. For instance, the end cap element 111 can have projections 11*a* that are configured to be matingly insertable into apertures 103*c* defined within a central aperture of the upper frame element 103 between the first and second grooves 103*a* and 103*b*. One or more attachment mechanisms (e.g. fasteners) can also be utilized to facilitate the connection of the end cap element to the upper frame element 103.

The end cap element 111 can also define an upper cavity or upper opening 111*b* for receipt of a portion of a power cord to facilitate connection of the power cord to the light emitting device 106. A terminal end portion 115*a* of a power cord 115 can be attached to the portion 106*a* of the light emitting device 106 by being passed into opening 11*b* and through an aperture that is aligned with the portion 106*a* of the light emitting device 106. The cord 115 can extend from this portion 106, out of opening 11*b*, and to an outlet 117 located on a ceiling or adjacent a ceiling or other power source. A cover element 113 can be attached to the end cap element 111 to cover most of the opening 11*b*, while defining an aperture 113*a* therein to permit the cord 115 to extend therethrough for passing out of the end cap element to the power source.

Mounting devices 53 can be attached to the upper frame element 103 to position the upper frame element above a workspace or adjacent a workspace so that light emitted from the light emitting device 106 can be directed to a workspace for providing light to personnel working in the workspace. For example, mounting devices 53 may be attached to the upper frame element 103 for mounting of the upper frame element to a ceiling above a work space. The glass panel elements that define the gaps 22 and cavity 107 can absorb audible noise generated from that work space to provide a substantial noise reduction while the light emitting device is providing light to the work space.

It should be appreciated that embodiment of the noise reduction apparatuses may be made or structured in a number of different ways to meet a particular set of design criteria. For example, the glass composition of each glass panel of such an apparatus can be selected to meet a particular set of design criteria. The glass of a glass panel can be a glass that is composed of a PMMA (e.g. acrylic glass) or can be a glass that is tempered or be another type of glass (e.g. a polymer glass, an alkali-aluminosilicate glass, a sapphire glass (synthetic sapphire), etc.). As yet another example, frames 13 can be structured in different ways to meet different sets of design criteria for noise reduction apparatuses. The gap 22 between corresponding and spaced apart first and second panel elements (e.g. first and second glass panel elements 21 and 23) can be any suitable range of distances to help define a sized cavity between the first and second panel elements for providing a pre-selected level of noise reduction while also providing a desired structure and aesthetic effect for a particular type of apparatus. The frames in the different noise reduction apparatus embodiments can be configured for mounting or forming of wall coverings, forming booths, forming shelving, forming furniture, forming privacy screens, forming baffles, or forming other types of devices that may be positioned in a workspace.

As yet another example, embodiments of the noise reduction apparatus can utilize any number of different sets of pairs of first and second glass panel elements to meet a particular set of design criteria. For instance, only one such pair may be included in some embodiments while other embodiments may utilize a number of rows R and/or columns C of such pairs of spaced apart first and second glass panel elements 21 and 23. As yet another example, embodiments can be configured so that a first glass panel element 21 has holes 24 and a second panel element does not have holes 24 and is composed of solid glass, wood, or another type of material. Such embodiments may be utilized to help provide a different aesthetic effect or meet some other design objective (e.g. cost of manufacture, a desired aesthetic, etc.). For some of these types of embodiments, the size of the gap 22 between the first glass panel element having holes 24 and the second panel element made of glass or other material that do not have holes can have a larger size to define a larger cavity for a greater noise reduction capacity. Such embodiments can be structured as tiles 20*a* or be utilized in rows R and columns C of pairs of first and second panel elements that are connected to each other via a frame 13 or at least one frame element or connector. Thus, while certain exemplary embodiments of the noise reduction apparatuses and methods of making and using the same have been shown and described above, it is to be distinctly understood that the invention is not limited thereto but may be otherwise variously embodied and practiced within the scope of the following claims.

What is claimed is:

1. A noise reduction apparatus comprising:

a first glass panel element having holes defined therein; and a second glass panel element positioned adjacent and spaced apart from the first glass panel element to define a gap between the first glass panel element and the second glass panel element, the second glass panel element having holes defined therein, the first glass panel element and the second glass panel element positioned to define exterior surfaces of the noise reduction apparatus, the holes of the first glass panel element being in fluid communication with the gap to direct acoustic waves into the gap for absorbing sound within the gap to reduce audible noise within a work space in which the noise reduction apparatus is positionable, the holes of the second glass panel element being in fluid communication with the gap to direct acoustic waves into the gap for absorbing sound within the gap to reduce audible noise within the work space in which the noise reduction apparatus is positionable, a frame and/or a plurality of connectors connected to the first glass panel element and the second glass panel element such that the first glass panel element and the second glass panel element are positionable within a room of a building adjacent a work surface of furniture within the room of the building or within the room of the building adjacent to the furniture.

2. The noise reduction apparatus of claim 1 wherein the frame or the plurality of connectors connected to the first glass panel element and the second glass panel element comprise:

an upper frame element, the first glass panel element attached to a first side of the upper frame element and the second glass panel element attached to a second side of the upper frame element, the upper frame element attached to the at least one mounting device to position the upper frame element below a ceiling and above the furniture within the room of the building;

a first connector positioned in the gap and a second connector positioned within the gap;

the first connector extending between the first glass panel element and second glass panel element adjacent a first side of the first glass panel element and adjacent a first side of the second glass panel element; and the second connector extending between the first glass panel element and second glass panel element adjacent a second side of the first glass panel element and adjacent a second side of the second glass panel element.

3. The noise reduction apparatus of claim 2 wherein the first side of the first glass panel element is opposite the second side of the first glass panel element.

4. The noise reduction apparatus of claim 1, comprising an upper frame element attached to a light emitting device, the first glass panel element attached to a first side of the upper frame element and the second glass panel element attached to a second side of the upper frame element, the light emitting device positioned between the first glass panel element and the second glass panel element so that light is emittable within the gap.

5. The noise reduction apparatus of claim 4, wherein the gap is open at a bottom of the gap between a bottom of the first glass panel element and a bottom of the second glass panel element.

6. The noise reduction apparatus of claim 1, wherein the frame is comprised of:

a first frame member having a first groove and a second groove;

a second frame member having a first groove and a second groove;

a first edge of the first glass panel element within the first groove of the first frame member, a second edge of the first glass panel element within the first groove of the second frame member; and a first edge of the second glass panel element within the second groove of the first frame member, a second edge of the second glass panel element within the second groove of the second frame member.

7. The noise reduction apparatus of claim 1, wherein the frame is comprised of:

a first frame member having a first groove and a second groove;

a first edge of the first glass panel element within the first groove of the first frame member; and a first edge of the second glass panel element within the second groove of the first frame member.

8. The noise reduction apparatus of claim 1, wherein the connectors extend between the first glass panel element and the second glass panel element within the gap, the gap being defined such that at least one peripheral edge of the gap is open.

9. The noise reduction apparatus of claim 1, wherein the first glass panel element and the second glass panel element are arranged to define a tile and the frame includes a subframe element that defines a side of the tile.

10. The noise reduction apparatus of claim 9, wherein the frame is attachable to a rail positionable adjacent the work surface.

11. The noise reduction apparatus of claim 10, comprising an inter-tile connector positionable adjacent to the subframe element.

12. The noise reduction apparatus of claim 1, wherein the noise reduction apparatus is configured as a free standing partition, a free standing booth, a booth, or free standing furniture.

13. A noise reduction apparatus comprising:

a plurality of first glass panel elements having holes;

a plurality of second glass panel elements having holes, each of the second glass panel elements spaced apart from and positioned opposite a corresponding one of the first glass panel elements to define a gap therebetween;

a frame and/or connectors attached to the first glass panel elements and the second glass panel element so that the gaps are in communication with each other and form a cavity, the holes of the first glass panel elements and the holes of the second glass panel elements in communication with the cavity such that acoustic waves passing through air external to and adjacent the noise reduction apparatus are passable into the cavity via the holes of the first glass panel elements and also the holes of the second glass panel elements for sound absorption.

14. The noise reduction apparatus of claim 13, wherein the gaps are defined such that one or more peripheral edges of the gaps are open.

15. The noise reduction apparatus of claim 13, wherein the frame is positionable adjacent furniture inside a room of the building or on a work surface of the furniture inside the room of the building.

16. The noise reduction apparatus of claim 13, wherein the connectors comprise:

a first connector connecting a respective one of the first glass panel elements and a respective one of the second glass panel elements such that the first connector is within the gap between the first and second glass panel elements to which the first connector is connected and extends with that gap between a first side of the first glass panel element and adjacent a first side of the second glass panel element; and a second connector connecting a respective one of the first glass panel elements to a respective one of the second glass panel elements such that the second connector is within the gap between the first and second glass panel elements to which the second connector is connected and extends between the first glass panel element and the second glass panel element adjacent a second side of the first glass panel element and adjacent a second side of the second glass panel element.

17. The noise reduction apparatus of claim 13, wherein:

the frame comprises an upper frame element having a first groove and a second groove spaced apart from the first groove;

an upper edge of each of the first glass panel elements positioned within the first groove; and an upper edge of each of the second glass panel elements positioned within the second groove.

18. A method of providing a noise reduction apparatus, comprising:

obtaining glass for glass panel elements; and positioning a first glass panel element having holes defined therein adjacent a second glass panel element by attaching the first glass panel element and a second glass panel element to a frame and/or to a plurality of spaced apart connectors, the second glass panel element positioned adjacent and spaced apart from the first glass panel element via the frame and/or the connectors to define a gap between the first glass panel element and second glass panel element, the gap being open at a bottom of the gap; the holes of the first glass panel element in fluid communication with the gap to direct acoustic waves into the gap for absorbing sound within the gap to reduce audible noise within a room of a building in which the noise reduction apparatus is positionable, and holes defined in the second glass panel element being in fluid communication with the gap to direct acoustic waves into the gap for absorbing sound within the gap to reduce audible noise within the room of a building in which the noise reduction apparatus is positionable;

positioning the noise reduction apparatus adjacent to a work surface of furniture within the room of the building or above furniture within the room of the building such that acoustic waves passing through air within the room that is external to and adjacent the noise reduction apparatus are passable into the gap via the holes of the first glass panel element and also via the holes of the second glass panel element for sound absorption.

19. The method of claim 18, wherein the connectors are used to position the first glass panel element adjacent the second glass panel element to define the gap, the gap being defined such that at least one peripheral edge of the gap is open.

20. The method of claim 18, wherein the connectors are used to position the first glass panel element adjacent the second glass panel element to define the gap via an attachment process, the connectors positioned so that the gap is defined such that peripheral edges of the gap are open; the attachment process comprises:

attaching a first connector to the first glass panel and the second glass panel element such that the first connector is within the gap and extends between the first glass panel element and second glass panel element adjacent a first side of the first glass panel element and adjacent a first side of the second glass panel element; and attaching a second connector to the first glass panel element and the second glass panel element such that the second connector is within the gap and extends between the first glass panel element and the second glass panel element adjacent a second side of the first glass panel element and adjacent a second side of the second glass panel element.

* * * * *